US006579387B1

(12) United States Patent
Selepack et al.

(10) Patent No.: US 6,579,387 B1
(45) Date of Patent: Jun. 17, 2003

(54) CONTINUOUS CASTING PROCESS FOR PRODUCING ALUMINUM ALLOYS HAVING LOW EARING

(75) Inventors: Mark S. Selepack, Jackson, TN (US); Theodore E. Blakely, Henderson, NV (US); Harry L. Lawrence, San Antonio, TX (US); Jackie S. Ivy, Jonesboro, AR (US); Charles Pridmore, Bowling Green, KY (US)

(73) Assignee: Nichols Aluminum - Golden, Inc., Houston, TX (US)

( * ) Notice: Subject to any disclaimer, the term of this patent is extended or adjusted under 35 U.S.C. 154(b) by 0 days.

(21) Appl. No.: 09/445,477

(22) PCT Filed: May 29, 1998

(86) PCT No.: PCT/US98/11235

§ 371 (c)(1),
(2), (4) Date: Jul. 13, 2000

(87) PCT Pub. No.: WO98/55663

PCT Pub. Date: Dec. 10, 1998

Related U.S. Application Data

(63) Continuation-in-part of application No. 08/864,883, filed on Jun. 4, 1997, now Pat. No. 5,985,085, which is a continuation-in-part of application No. 08/869,817, filed on Jun. 4, 1997, now Pat. No. 5,993,573, which is a continuation-in-part of application No. 08/869,245, filed on Jun. 4, 1997, now Pat. No. 5,976,279.

(60) Provisional application No. 60/052,326, filed on Jul. 11, 1997.

(51) Int. Cl.[7] ..... C22F 1/04

(52) U.S. Cl. ..... 148/552; 148/551; 148/692

(58) Field of Search ..... 148/551, 552, 148/692, 693, 439, 688, 696, 417, 440; 164/459, 462, 476, 477

(56) References Cited

U.S. PATENT DOCUMENTS

| | | | | |
|---|---|---|---|---|
| 3,787,248 | A | 1/1974 | Setzer et al. | 148/11.5 |
| 3,930,895 | A | 1/1976 | Moser et al. | 148/2 |
| 4,028,141 | A | 6/1977 | Chia et al. | 148/2 |
| 4,111,721 | A | 9/1978 | Hitchler et al. | 148/2 |
| 4,151,013 | A | 4/1979 | Thompson et al. | 148/11.5 |
| 4,151,896 | A | 5/1979 | Nicoud et al. | 148/2 |
| 4,235,646 | A | 11/1980 | Neufeld et al. | 148/2 |
| 4,238,248 | A | 12/1980 | Gyöngyös et al. | 148/2 |
| 4,260,419 | A | 4/1981 | Robertson | 148/142 |

(List continued on next page.)

FOREIGN PATENT DOCUMENTS

| | | |
|---|---|---|
| EP | 0 485 949 A1 | 5/1992 |
| EP | 93304424.0 | 7/1993 |
| EP | 93304426.5 | 7/1993 |
| JP | 4221036 | 8/1992 |
| JP | 04 224651 | 12/1992 |
| WO | WO 90/10091 | 9/1990 |
| WO | WO 96/28582 | 9/1996 |

OTHER PUBLICATIONS

Dieter, Mechanical Metallurgy, 2nd edition, pp 613–614, Dec. 1961.*

Don McAuliffe, "Production of Continuous Cast Can Body Stock", Paper presented at AIME Meeting, Feb. 27, 1989, 7 pages.

*Primary Examiner*—Scott Kastler
(74) *Attorney, Agent, or Firm*—Sheridan Ross P.C.

(57) ABSTRACT

The present invention provides an improved process for continuously casting aluminum alloys and improved aluminum alloy compositions. The process includes the steps of continuously annealing the cold rolled strip in an intermediate anneal using an induction heater and/or continuously annealing the hot rolled strip in an induction heater. The alloy composition has mechanical properties that can be varied selectively by varying the time and temperature of a stabilizing anneal.

27 Claims, 8 Drawing Sheets

U.S. PATENT DOCUMENTS

| | | | | |
|---|---|---|---|---|
| 4,269,632 | A | 5/1981 | Robertson et al. | 148/2 |
| 4,282,044 | A | 8/1981 | Robertson et al. | 148/2 |
| 4,318,755 | A | 3/1982 | Jeffrey et al. | 148/11.5 |
| 4,334,935 | A | 6/1982 | Morris | 148/2 |
| 4,407,679 | A | 10/1983 | Manzonelli et al. | 148/2 |
| 4,411,707 | A | 10/1983 | Brennecke et al. | 148/2 |
| 4,424,084 | A | 1/1984 | Chisholm | 148/417 |
| 4,441,933 | A | 4/1984 | Boutin et al. | 148/2 |
| 4,498,523 | A | 2/1985 | Bowman et al. | 164/477 |
| 4,517,034 | A | 5/1985 | Merchant et al. | 148/439 |
| 4,526,625 | A | 7/1985 | Merchant et al. | 148/2 |
| 4,582,541 | A | 4/1986 | Dean et al. | 148/2 |
| 4,589,932 | A | 5/1986 | Park | 148/12.7 |
| 4,605,448 | A | 8/1986 | Baba et al. | 148/11.5 |
| 4,614,224 | A | 9/1986 | Jeffrey et al. | 164/476 |
| 4,614,552 | A | 9/1986 | Fortin et al. | 148/417 |
| 4,626,294 | A | 12/1986 | Sanders, Jr. | 148/11.5 |
| 4,637,842 | A | 1/1987 | Jeffrey et al. | 148/12.7 |
| 4,645,544 | A | 2/1987 | Baba et al. | 148/12.7 |
| 4,718,948 | A | 1/1988 | Komatsubara et al. | 148/2 |
| 4,753,685 | A | 6/1988 | Usui et al. | 148/2 |
| 4,855,107 | A | 8/1989 | Teirlinck et al. | 420/546 |
| 4,861,388 | A | 8/1989 | Fortin et al. | 148/2 |
| 4,872,921 | A | 10/1989 | Teirlinck | 148/2 |
| 4,929,285 | A | 5/1990 | Zaidi | 148/11.5 |
| 4,976,790 | A | 12/1990 | McAuliffe et al. | 148/2 |
| 4,988,394 | A | 1/1991 | Cho | 148/12.7 |
| 5,061,327 | A | 10/1991 | Denzer et al. | 148/12.7 |
| 5,089,490 | A | 2/1992 | Durckheimer et al. | 148/12.7 |
| 5,104,459 | A | 4/1992 | Chen et al. | 148/11.5 |
| 5,104,465 | A | 4/1992 | McAuliffe et al. | 148/439 |
| 5,106,429 | A | 4/1992 | McAuliffe et al. | 148/2 |
| 5,110,545 | A | 5/1992 | McAuliffe et al. | 420/534 |
| 5,133,402 | A | 7/1992 | Ross | 164/431 |
| 5,156,683 | A | 10/1992 | Ross | 118/620 |
| 5,192,378 | A | 3/1993 | Doherty et al. | 148/691 |
| 5,356,495 | A | 10/1994 | Wyatt-Mair et al. | 148/551 |
| 5,362,341 | A | 11/1994 | Palmer et al. | 148/692 |
| 5,469,912 | A | 11/1995 | McAuliffe | 164/476 |
| 5,470,405 | A | 11/1995 | Wyatt-Mair et al. | 148/551 |
| 5,496,423 | A | 3/1996 | Wyatt-Mair et al. | 148/551 |
| 5,514,228 | A | 5/1996 | Wyatt-Mair et al. | 148/551 |
| 5,681,405 | A | 10/1997 | Newton et al. | 148/551 |
| 5,833,775 | A | 11/1998 | Newton et al. | 148/551 |
| 5,976,279 | A | 11/1999 | Selepack et al. | 148/552 |
| 5,985,058 | A | 11/1999 | Selepack et al. | 148/551 |
| 5,993,573 | A | 11/1999 | Selepack et al. | 148/551 |
| 6,120,621 | A | 9/2000 | Jin et al. | |

* cited by examiner

CONTINUOUS CASTING PROCESS FOR PRODUCING ALUMINUM ALLOYS HAVING LOW EARING

CROSS REFERENCE TO RELATED APPLICATION

The present application is a 35 U.S.C. §371 national stage application of PCT/US98/11235 filed May 29, 1998 which claims priority under 35 U.S.C. §119(e) U.S. Provisional Application No. 60/052,326 filed Jul. 11, 1997 and is a continuation-in-part under 35 U.S.C. §120 of U.S. application Ser. No. 08/864,883, filed Jun. 4, 1997, now U.S. Pat. No. 5,985,085; U.S. application Ser. No. 08/869,817, filed Jun. 4, 1997, now U.S. Pat. No. 5,993,573; and, U.S. application Ser. No. 08/869,245, filed Jun. 4, 1997, now U.S. Pat. No. 5,976,279.

FIELD OF THE INVENTION

The present invention relates generally to aluminum alloy sheet and methods for making aluminum alloy sheet and specifically to aluminum alloy sheet and methods for making aluminum alloy sheet for use in forming drawn and ironed container bodies.

BACKGROUND OF THE INVENTION

Aluminum beverage containers are generally made in two pieces, one piece forming the container sidewalls and bottom (referred to herein as a "container body") and a second piece forming a container top. Container bodies are formed by methods well known in the art. Generally, the container body is fabricated by forming a cup from a circular blank aluminum sheet (i.e., body stock) and then extending and thinning the sidewalls by passing the cup through a series of dies having progressively smaller bore sizes. This process is referred to as "drawing and ironing" the container body. The ends of the container are formed from end stock and attached to the container body. The tab on the upper container end that is used to provide an opening to dispense the contents of the container is formed from tab stock.

Aluminum alloy sheet is most commonly produced by an ingot casting process. In the process, the aluminum alloy material is initially cast into an ingot, for example, having a thickness ranging from about 20 to about 30 inches. The ingot is then homogenized by heating to an elevated temperature, which is typically 1075° F. to 1150° F., for an extended period of time, such as from about 6 to about 24 hours. "Homogenization" refers to a process whereby ingots are raised to temperatures near the solidus temperature and held at that temperature for varying lengths of time. The process reduces microsegregation by promoting diffusion of solute atoms within the grains of alumina and improves workability. Homogenization does not alter the crystal structure of the ingot. The homogenized ingot is then hot rolled in a series of passes to reduce the thickness of the ingot. The hot rolled sheet is then cold rolled to the desired final gauge.

Although ingot casting is a common technique for producing aluminum alloy sheet, a highly advantageous method for producing aluminum alloy sheet is by continuously casting molten metal. In a continuous casting process, molten metal is continuously cast directly into a relatively long, thin slab and the cast slab is then hot rolled and cold rolled to produce a finished product.

Some alloys are not readily cast using a continuous casting process into an aluminum sheet having mechanical properties suitable for forming operations, especially for making drawn and ironed container bodies. By way of example, some alloys have low yield and tensile strengths, a low degree of formability and/or a high earing which lead to a number of problems.

It would be desirable to have a continuous aluminum casting process in which the aluminum alloy sheet can be readily fabricated into desired objects. It would be advantageous to have a continuous casting process in which the aluminum alloy sheet has a high degree of formability, low earing and high strength.

SUMMARY OF THE INVENTION

These and other needs are addressed by the process and alloy compositions of the present invention. In a first embodiment, the method can include the steps of:

(a) continuously casting an aluminum alloy melt to form a cast strip;

(b) hot rolling the cast strip to form a hot rolled strip;

(c) cold rolling the hot rolled strip to form an intermediate cold rolled strip;

(d) continuously annealing the intermediate cold rolled strip at a temperature ranging from about 371 to about 565° C. to form an intermediate annealed strip; and (e) cold rolling the intermediate cold rolled strip to form aluminum alloy sheet.

The use of a continuous anneal can provide significant savings in operating and alloy costs and improvements in production capacity. As will be appreciated, batch anneals require a significantly increased amount of labor to perform, and batch anneal ovens have a limited capacity.

The continuous annealing step (d) is preferably conducted in an induction heater with a transflux induction furnace being most preferred. The annealing step (d) surprisingly yields an intermediate annealed strip having mechanical properties (i.e., yield tensile strength and ultimate tensile strength) that can be selectively controlled by varying the temperature and duration of a later stabilizing or back annealing step (collectively referred to as a "stabilizing anneal"). For the induction furnace, the residence time of any portion of the cold rolled strip in the continuously annealing step (d) ranges from about 2 to about 30 seconds.

It has been discovered that induction heaters can provide aluminum alloy sheet having not only a finer grain size but also a substantially uniform distribution of the finer grain size throughout the coil formed by the intermediate annealed strip. The relatively fine grain size can provide not only more uniform mechanical properties throughout the coil but also mechanical properties that are controllable by varying the temperature and duration of a later stabilizing or back annealing step.

The induction furnace can be superior to radiant furnaces in annealing aluminum alloys because the induction furnace more uniformly heats the strip. Radiant furnaces place the strip in a heated atmosphere and rely on thermal transfer to anneal the entire cross-section of the strip, which can lead to more exposure of the exterior portions of the strip/coil to heat and less exposure of the middle of the strip/coil to heat. In contrast, induction furnaces use electromagnetic energy to heat the strip substantially uniformly throughout the strip's cross-section. Accordingly, induction heaters can provide for greater gains in mechanical properties through annealing than radiant heaters and, therefore, permit the use of lower amounts of expensive alloying elements to realize selected mechanical properties.

Aluminum alloy sheet produced by this process is especially useful as body stock in canmaking applications. To provide the desired low earing for container manufacture, cold rolling step (c) can be used to produce a relatively large reduction in the gauge of the strip while cold rolling step (e) is used to produce a relatively low reduction in the gauge of the intermediate cold rolled strip (i.e., a low amount of work hardening). The low amount of work hardening can produce a concomitant relatively low increase in yield and ultimate tensile strengths. The yield and ultimate tensile strengths can then be increased to desired levels in a later stabilizing annealing step by selecting the appropriate annealing or back temperature and time, without a significant increase in earing.

Other embodiments of the method employ the induction furnace in annealing steps performed after hot rolling, such as in a stabilizing anneal. The unique performance advantages of the induction furnace can provide highly desirable mechanical properties in the aluminum alloy sheet which can be controlled in later annealing steps as noted above.

In a particularly preferred process for producing aluminum sheet useful as body stock, a number of additional steps. The complete process includes the following steps:

(a) continuously casting an aluminum alloy melt to form a cast strip having a cast output temperature;

(b) heating the cast strip, either before hot rolling or after partial hot rolling, to a heated temperature that is from about 6 to about 52° C. more than the cast output temperature to cause later recrystallization of the cast strip after step (c) below;

(c) hot rolling the cast strip to form a hot rolled strip;

(c) cold rolling the hot rolled strip to form an intermediate cold rolled strip;

(d) intermediate annealing of the intermediate cold rolled strip in an induction furnace at a temperature ranging from about 371 to about 565° C. to form an intermediate annealed strip; and (e) cold rolling the intermediate cold rolled strip to form aluminum alloy sheet.

After step (e), the aluminum alloy sheet can be subjected to a stabilizing anneal, as desired, to provide desired mechanical properties. "Recrystallization" refers to a change in grain structure without a phase change as a result of heating of the strip above the strip's recrystallization temperature.

An alloy useful in this process for producing body stock has the following composition:

(i) from about 0.9 to about 1.5% by weight magnesium, (ii) from about 0.8 to about 1.2% by weight manganese, (iii) from about 0.05 to about 0.5% by weight copper, (iv) from about 0.05 to about 0.5% by weight iron, and (v) from about 0.05 to about 0.5% by weight silicon.

Body stock produced using this alloy and process can have particularly attractive properties. By way of example, the aluminum alloy sheet can have an as-rolled yield strength of at least about 38 ksi, an as-rolled tensile strength of at least about 42.5 ksi, an earing of less than about 1.8%, and/or an elongation of at least about 3%. As will be appreciated, "earing" is typically measured by the 45 degree earing or 45 degree rolling texture. Forty-five degrees refers to the position of the aluminum alloy sheet which is 45 degrees relative to the rolling direction. The value for the 45 degree earing is determined by measuring the height of the ears which stick up in a cup, minus the height of valleys between the ears. The difference is divided by the height of the valleys and multiplied by 100 to convert to a percentage. Surprisingly, strip that is intermediate annealed using an induction heater generally has as-rolled yield and tensile strengths that are about 3 to about 5 ksi more than that of a strip that is intermediate annealed using a batch heater.

Container bodies produced from the body stock can also have superior properties. Container bodies produced from aluminum alloy sheet can have a buckle strength of at least about 90 psi and a column strength of at least about 180 psi.

DETAILED DESCRIPTION

Introduction

Figure 1:
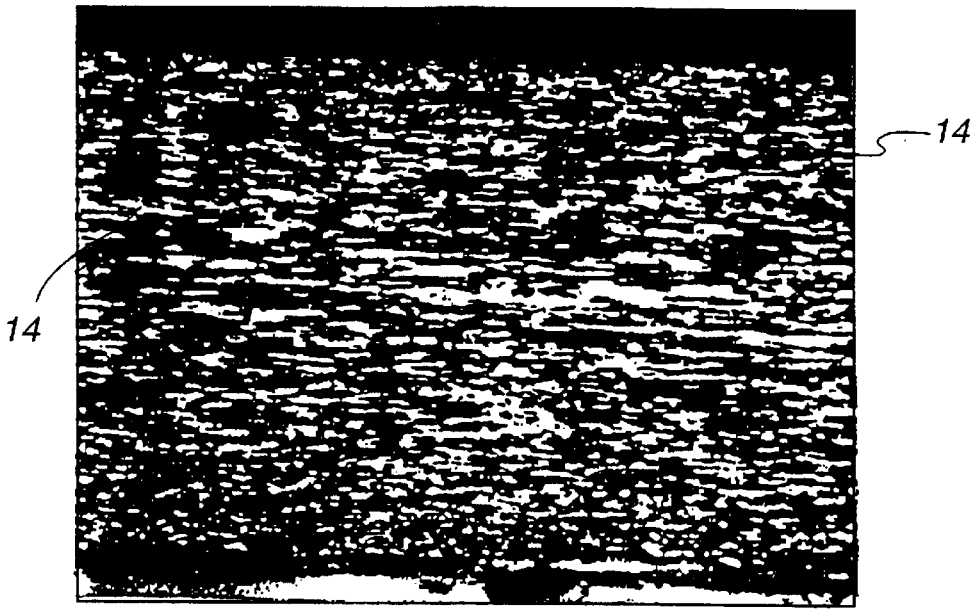
FIG. 1 is a diagram of the equiaxed grain structure of aluminum alloy stock produced according to the present invention.

The various continuous casting processes of the present invention have a number of novel process steps for producing aluminum alloy sheet having high strength, low earing, highly desirable forming properties, and/or an equiaxed/finer grain structure. As used herein, "continuous casting" refers to a casting process that produces a continuous strip as opposed to a process producing a rod or ingot. By way of example, the continuous casting processes can include heating the cast strip in front of the last hot mill stand (i.e., between the caster and first hot mill stand or between hot mill stands). The heater can reduce the load on the hot mill stands, thereby permitting greater reductions of the cast strip in the hot mill, provide a hot milled strip having an equiaxed grain structure, and/or facilitate self-annealing (i.e., recrystallization) of the unheated strip when the unheated strip is cooled, thereby obviating, in many cases, the need for a hot mill anneal. The increased hot mill reductions can eliminate one or more cold mill passes. The processes can further include continuous intermediate annealing of the cold rolled strip in an induction heater. The continuous anneal can provide more uniform mechanical properties for the aluminum alloy sheet, a finer grain size, controllable mechanical properties using a stabilizing anneal, and significant savings in operating and alloy costs and improvements in production capacity. It is a surprising and unexpected discovery that an induction heater in the continuous intermediate anneal can produce aluminum alloy sheet, that is useful for body stock, having yield and ultimate tensile strengths and percent elongation at break that are closely related to the temperature and duration of the stabilizing anneal. Commonly, the yield and ultimate tensile strengths of body stock decrease with increasing anneal time and temperature. These superior properties of the aluminum sheet of the present invention result from the relatively fine grain size and alloying of the sheet. The intermediate anneal is particularly useful for body stock. Finally, the continuous casting processes can include stabilization or back annealing of the cold rolled strip in an induction heater. The induction heater can provide aluminum alloy sheet having highly desirable properties, particularly useful for the production of body stock used for containers.

An important aspect of the present invention is that the aluminum alloy sheet that is produced in accordance with the various embodiments of the present invention can maintain sufficient strength and formability properties while having a relatively thin gauge. This is especially important when the aluminum alloy sheet is utilized in tab, end, and body stock for making drawn and ironed containers. The trend in the can making industry is to use thinner aluminum alloy sheet for the production of drawn and ironed containers, thereby producing a container containing less aluminum and having a reduced cost. However, to use thinner gauge aluminum sheet, the aluminum alloy sheet must still have the required physical characteristics. Surprisingly, continuous casting processes have been discovered which produce an aluminum alloy sheet that meets the industry's standards for tab, end, and/or body stock, particularly when utilized with the alloys of the present invention.

Heating the Cast Strip Between the Caster and First Hot Mill or Between Hot Mill Stands In the first novel process step discussed above, the cast and/or partially hot rolled strip (hereinafter collectively referred to as "unheated strip") is heated to an elevated temperature to provide an aluminum alloy sheet having a more equiaxed grain structure relative to other aluminum alloy sheet and to permit greater thickness reductions in hot milling. While not wishing to be bound by any theory, it is believed that the heater causes the strip to self-anneal, or recrystallize, after hot milling is completed, to form the equiaxed grain structure.

Figure 2:
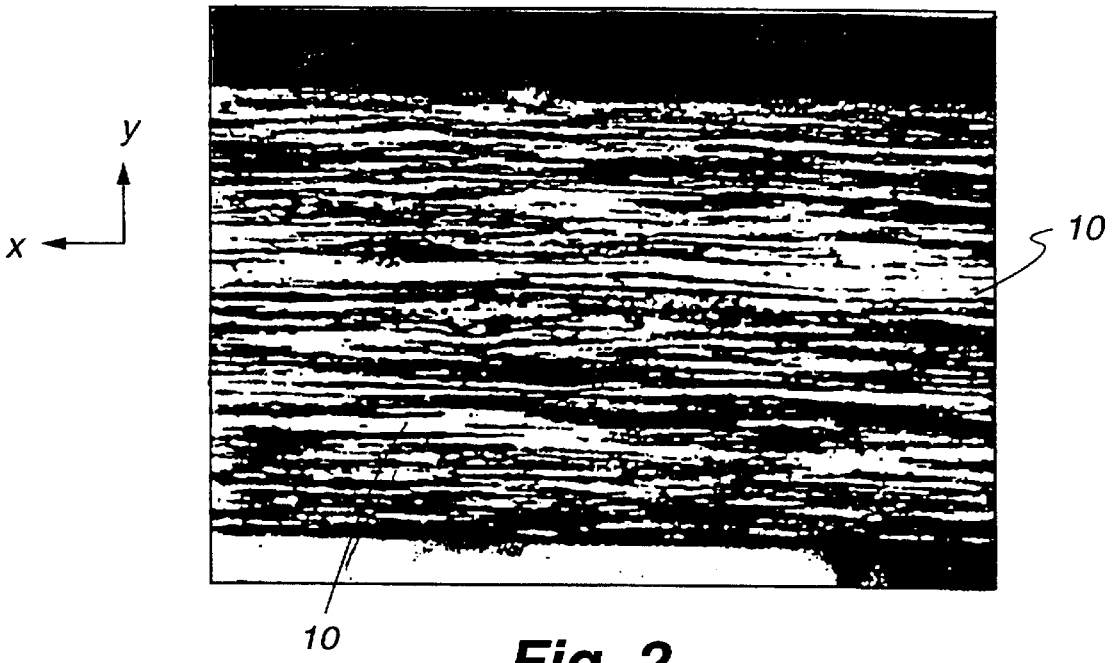
FIG. 2 is a diagram of the striated grain structure of aluminum alloy stock produced according to a conventional process.

Referring to FIGS. 1 and 2, the substantial differences in grain structure between the aluminum alloy sheet of the present invention and a comparative aluminum alloy sheet are illustrated. As shown in FIG. 2, the grains 10 of continuously cast comparative aluminum-alloy sheet are shaped as a series of striations (i.e., long lenticular grains) oriented longitudinally throughout the aluminum alloy sheet. As will be appreciated, the striations cause the aluminum alloy sheet to have a high strength in the direction "X" parallel to the orientation of the striation and low strength in the direction "Y" that is normal to the direction of the striation (i.e., low shear strength). As a result, during fabrication, the comparative aluminum alloy sheet experiences edge cracking and excessive fines generation. Referring to FIG. 1, the aluminum alloy sheet of the present invention has a substantially equiaxed grain structure providing a relatively high strength substantially uniformly in all directions. An equiaxed grain structure provides a high degree of formability of the sheet, with a low degree of edge cracking, fines generation and earing.

The heating step is preferably conducted on a continuous as opposed to a batch basis and can be conducted in any suitable heating device. Preferred furnaces are solenoidal heaters, induction heaters, such as transflux induction furnaces, infrared heaters, and gas-fired heaters with solenoidal heaters being most preferred. Gas-fired heaters are less preferred for elevating the temperature of the unheated strip to the desired levels due to the limited ability of gas-fired heaters to reach the desired annealing temperatures at a reasonable cost and time allotted.

Preferably, the unheated strip is heated to a temperature (i.e., the output temperature of the heated strip as it exits the heater) that is in excess of the temperature of the unheated strip (i.e., the input temperature of the unheated strip as it enters the heater) and the recrystallization temperature of the strip but less than the melting point of the cast strip. Preferably, the heated temperature exceeds the heater input temperature of the unheated strip by at least about 20° F. (i.e., about 6° C.) and most preferably by at least about 50° F. (i.e., about 10° C.) but by no more than about 125° F. (i.e., about 52° C.) and most preferably by no more than about 80° F. (i.e., about 27° C.).

The temperature in the heating step depends upon whether the cast strip or partially hot rolled strip is heated. For heating of the cast strip, the minimum heated temperature preferably is about 820° F. (i.e., about 432° C.) and most preferably about 850° F. (i.e., about 454° C.) and the maximum heated temperature is about 1,080° F. (i.e., about 565° C.) and most preferably about 1,000° F. (i.e., about 538° C.). For heating of the partially hot rolled strip, the heated temperature preferably ranges from about 750° F. (i.e., about 399° C.) to about 850° F. (i.e., about 454° C.). If the heated temperature is too great, the aluminum alloy sheet produced from the cast strip can experience edge cracking during hot rolling. The residence time of any portion of the unheated strip in the continuous heater is preferably at least about 8 seconds and no more than about 3 minutes, more preferably no more than about 2 minutes and most preferably no more than about 30 seconds. Other than cooling experienced in hot rolling, the heated strip is preferably not subjected to rapid cooling, such as by quenching, before hot milling.

It has been discovered that the thickness of the unheated strip is important to the degree of post hot mill self-annealing (i.e., recrystallization) realized due to the heating of the strip before hot milling. If the strip is too thick, portions of the strip can fail to be completely heated. Preferably, the gauge of the unheated strip is no more than about 24 mm, more preferably ranges from about 12 to about 24 mm, and most preferably ranges from about 16 to about 19 mm.

Continuous Intermediate Annealing of the Cold Rolled Strip in an Induction Heater In the second novel process step, a partially cold rolled strip is subjected to a continuous high temperature anneal to yield an aluminum sheet having a high degree of formability, substantially uniform physical properties, and strength properties that are controllable (i.e., the strength properties can increase with increasing temperature and time of stabilization or back annealing). The continuous anneal is preferably performed in an induction heater, such as a transflux induction furnace.

While not wishing to be bound by any theory, it is believed that these properties result from the ability of the induction heater to uniformly heat the partially cold rolled strip throughout its volume to produce a substantially uniform, fine-grain size throughout the length and width of the intermediate annealed strip. This is so because the induction heater magnetically induces magnetic fluxes substantially uniformly throughout the thickness of the strip. In contrast, conventional radiant heaters, particularly batch heaters, non-uniformly heat the partially cold rolled strip, whether in coiled or uncoiled form, throughout its volume.

In such heaters, heat is conducted from the outer surfaces of the strip/coil towards the middle of the strip/coil with the outer surfaces experiencing greater exposure to thermal energy than the middle of the strip/coil. The nonuniform exposure to heat can cause a variation in grain size, especially in annealed coils, along the length of the strip. The middle of the strip/coil commonly has a smaller grain size and the exterior of the strip/coil a larger grain size.

The minimum annealing temperature is preferably about 700° F. (i.e., about 371° C.), more preferably about 800° F. (i.e., about 426° C.), and most preferably about 850° F. (i.e., about 454° C.), and the maximum annealing temperature is preferably about 1050° F. (i.e., about 565° C.), more preferably about 1025° F. (i.e., about 547° C.), and most preferably about 1000° F. (i.e., about 537° C.). The minimum residence time of any portion of the annealed strip in the heater preferably is about 2 seconds, and the maximum residence time is preferably about 2.5 minutes, more preferably about 30 seconds, and most preferably about 20 seconds, depending on the line speed of the strip through the heater.

Stabilization or Back Annealing of the Cold Rolled Strip in an Induction Heater In yet another novel process step, a cold rolled strip is subjected to a stabilization or back anneal (hereinafter collectively referred to as "stabilizing anneal") in a continuous heater to form aluminum alloy sheet having highly desirable properties. As in the continuous intermediate anneal above, the stabilization or back anneal can produce aluminum sheet having predetermined physical properties and provide increased capacity. The physical properties are highly controllable by varying the temperature and duration of the anneal (i.e., the line speed of the strip through the heater).

The continuous heater is preferably an induction heater, with a transflux induction furnace being most preferred.

The annealing temperature preferably ranges from about 300 to about 550° F. (i.e., about 148 to about 287° C.). The minimum residence time of any portion of the cold rolled strip in the induction heater is preferably about 2 seconds and the maximum residence time of any portion of the cold rolled strip is preferably about 2.5 minutes, more preferably about 30 seconds, and most preferably about 20 seconds, depending upon the line speed of the strip through the heater.

Processes Incorporating the Novel Process Steps

Figure 3:
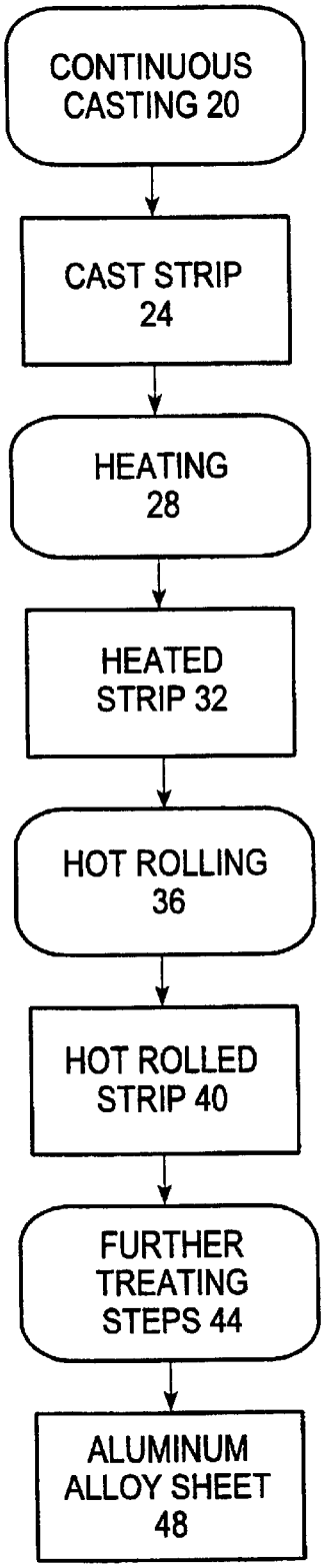
FIGS. 3, 4, 5 and 6 are block diagrams illustrating various embodiments of processes according to the present invention.

A first embodiment of a continuous casting process incorporating the step of heating the unheated strip is depicted in FIG. 3. This process is particularly useful for forming tab, body, and end stock for container manufacture.

Referring to FIG. 3, a melt of the aluminum alloy composition is formed and continuously cast 20 to form a cast strip 24. The continuous casting process can employ a variety of continuous casters, such as a belt caster or a roll caster. Preferably, the continuous casting process includes the use of a block caster for casting the aluminum alloy melt into a sheet. The block caster is preferably of the type disclosed in U.S. Pat. Nos. 3,709,281; 3,744,545; 3,747,666; 3,759,313 and 3,774,670, all of which are incorporated herein by reference in their entireties. Continuous casting is generally described in copending U.S. patent application Ser. Nos. 08/713,080 and 08/401,418, which are also incorporated herein by reference in their entireties.

The alloy composition according to the present invention can be formed in part from scrap metal material, such as plant scrap, container scrap and consumer scrap. Preferably, the alloy composition is formed with at least about 75% and more preferably at least about 95% total scrap for body stock and from about 5 to about 50% total scrap for tab and end stock.

To form the melt, the metal is charged into a furnace and heated to a temperature of about 1385° F. (i.e., 752° C.) (i.e., above the melting point of the feed material) until the metal is thoroughly melted. The alloy is treated to remove materials such as dissolved hydrogen and non-metallic inclusions which would impair casting of the alloy and the quality of the finished sheet. The alloy can also be filtered to further remove non-metallic inclusions from the melt. The melt is then cast through a nozzle and discharged into the casting cavity. The nozzle can include a long, narrow tip to constrain the molten metal as it exits the nozzle. The nozzle tip has a preferred thickness ranging from about 10 to about 25 millimeters, more preferably from about 14 to about 24 millimeters, and most preferably from about 14 to about 19 millimeters and a width ranging from about 254 millimeters to about 2160 millimeters.

The melt exits the tip and is received in the casting cavity which is formed by opposing pairs of rotating chill blocks. The metal cools and solidifies as it travels through the casting cavity due to heat transfer to the chill blocks. At the end of the casting cavity, the chill blocks, which are on a continuous web, separate from the cast strip 24. The blocks travel to a cooler where the treated chill blocks are cooled before being reused.

The cast temperature of the cast strip 24 exiting the block caster preferably exceeds the recrystallization temperature of the cast strip. The cast output temperature (i.e., the output temperature as the cast strip exits the caster) preferably ranges from about 800 to about 1050° F. (i.e., about 426 to about 565° C.) and more preferably from about 900 to about 1050° F. (i.e., about 482 to about 565° C.).

Upon exiting the caster, the cast strip is subjected to a heating (or annealing) step 28 as noted above to form a heated strip 32 having an equiaxed grain structure.

Upon exiting the heating step 28, the heated strip 32 is then subjected to hot rolling 36 in a hot mill to form a hot rolled strip 40. A hot mill includes one or more pairs of oppositely rotating rollers (i.e., one or more hot mill stands) having a gap separating the rollers that reduces the thickness of the strip as it passes through the gap between the rollers. The heated strip 32 preferably enters the hot mill with a minimum input temperature of about 800° F. (i.e., about 426° C.) and more preferably about 900° F. (i.e., about 482° C.) and a maximum input temperature of about 1000° F. (i.e., about 538° C.) and more preferably about 1000° F. (i.e., about 538° C.). The hot mill preferably reduces the thickness of the strip by at least about 80%, more preferably by at least about 84%, and most preferably by at least about 88% but by no more than about 94%. The gauge of the hot mill strip preferably ranges from about 0.065 to about 0.105 inches. The hot rolled strip preferably exits the hot mill with a minimum output temperature of about 550° F. (i.e., about 260° C.) and more preferably about 600° F. (i.e., about 315° C.) and a maximum output temperature of about 800° F. (i.e., about 426° C.) and more preferably about 800° F. (i.e., about 426° C.). In accordance with the present invention, it has been found that a relatively high reduction in gauge can take place with each pass of the hot rollers which can later eliminate one or more cold rolling passes.

For some alloys, the hot rolled strip 40 is commonly not annealed or solution heat treated directly after exiting the hot mill. The elimination of the additional annealing step and/or solution heat treating step (i.e., self-annealing) can lead to significant increases in capacity relative to processes using a batch anneal hot milling.

The hot rolled strip 40 is allowed to cool in a convenient manner to a temperature ranging from ambient temperature to about 120° F. (i.e., about 49° C.). Typically, the cooling time ranges from about 48 to about 72 hours. Depending upon the alloy, the strip 40 can be subjected to rapid cooling, such as by quenching, to cool the strip 40 for cold milling.

After the hot rolled sheet has cooled, it is subjected to further treating steps 44 to form the aluminum alloy sheet 48. The further treating steps 44 depend, of course, upon the alloy and intended use for the aluminum sheet 48.

Figure 4:
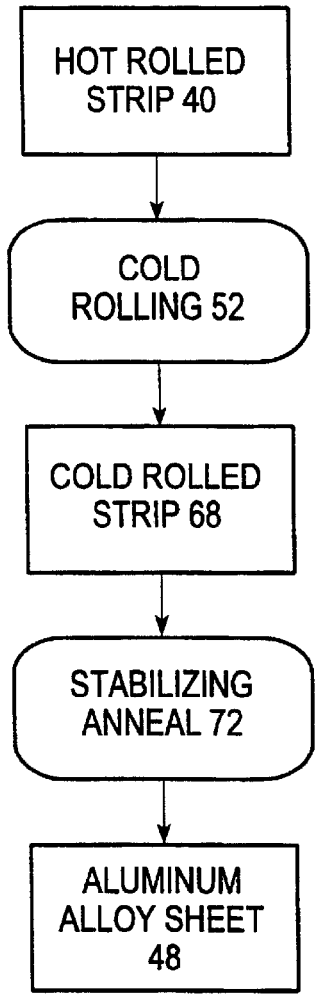

In one embodiment, FIG. 4 depicts the further treating steps 44 for tab stock useful in container fabrication. Referring to FIG. 4, the cooled hot rolled strip 40 is subjected to cold rolling 52 to form a cold rolled strip 68 having the final gauge. The cold rolling can be performed in a number of cold mill passes through one or more pairs of rotating cold rollers. During cold rolling 52, the thickness of the strip is preferably reduced by at least about 35%/stand and more preferably from about 35 to about 60%/stand and, more preferably, by from about 45 to about 55%/stand for a total reduction in the cold rolling step 52 preferably of at least about 70% and more preferably ranging from about 85 to about 95%. Preferably, the reduction to final gauge is performed in 2 to 3 passes through rotating cold rollers.

The final gauge is selected based on the final desired properties of the aluminum alloy sheet 48. Preferably, the minimum final gauge of the aluminum alloy sheet is about 0.20 mm, more preferably about 0.22 mm, and most preferably, about 0.24 mm while the maximum final gauge is about 0.61 mm, more preferably about 0.56 mm, and most preferably about 0.46 mm.

The cold rolled strip 68 is subjected to a stabilizing anneal 72 to form the aluminum alloy sheet 48. Although any heater can be employed in the stabilizing anneal, it is most preferred that a continuous heater, such as an induction heater, be used. The temperature and duration of a stabilizing anneal 72 utilizing an induction heater are discussed above. The temperature of a batch stabilizing 72 anneal preferably ranges from about 300 to about 500° F. (i.e., about 149 to about 260° C.). The duration of a batch stabilizing anneal 72 preferably ranges from about 10 to about 20 hours.

In one process configuration, the stabilizing anneal can be located in the tab cleaning line. As will be appreciated, the tab cleaning line includes the steps of (i) contacting the aluminum alloy sheet with a caustic cleaning solution, such as a caustic cleaning solution, to remove oil and other residue from the sheet; (ii) contacting the sheet with a rinsing solution, such as water, to remove the caustic cleaner from the sheet; and (iii) applying a lubricant, such as oil, to the rinsed sheet. The lubed sheet is later passed through a leveler and splitter to form tab stock. The stabilizing anneal 72 can be located directly before step (i) provided that the caustic cleaning solution has a lower concentration of caustic cleaner than conventional processes to avoid overetching of the sheet. Overetching can result from the increased temperature of the sheet due to the stabilizing anneal. Alternatively, the stabilizing anneal 72 can be located after step (i), such as between steps (i) and (ii) or steps (ii) and (iii), or after step (iii). This process configuration is highly beneficial because the ability to use more dilute caustic cleaning solutions due to more efficient cleaning caused by the higher sheet temperature from the stabilization annealing can result in significant cost savings.

Aluminum alloy sheet produced by this process is particularly useful as tab stock. An aluminum alloy composition that is particularly useful for tab stock includes:

(i) Manganese, preferably in an amount of at least about 0.05 wt % and more preferably at least about 0.10 0.20 wt % and no more than about 0.5 wt % and more preferably no more than about 0.20 wt %.

(ii) Magnesium, preferably in an amount ranging from about 3.5 to about 4.9 wt %.

(iii) Copper, preferably in an amount of at least about 0.05 wt % and no more than about 0.15 wt % and most preferably no more than about 0.10 wt %.

(iv) Iron, preferably in an amount of at least about 0.05 wt % and more preferably at least about 0.10 wt % and no more than about 0.35 wt % and more preferably no more than about 0.20 wt %.

(v) Silicon, preferably in an amount of at least about 0.05 wt % and no more than about 0.20 wt % and more preferably no more than about 0.10 wt %.

The aluminum alloy sheet 48 has properties that are particularly useful for tab stock. Preferably, the as-rolled yield strength is at least about 41 ksi and more preferably at least about 46 ksi and no more than about 49 ksi and more preferably no more than about 51 ksi. Preferably, the aluminum alloy sheet 48 has an elongation of at least about 3% and more preferably at least about 6% and no more than about 8%. The as-rolled tensile strength of the aluminum alloy sheet 48 preferably is at least about 49 ksi, more preferably at least about 55 ksi and most preferably at least about 57 ksi and no more than about 61 ksi, and most preferably no more than about 59 ksi. The sheet 48 preferably has a tab strength of at least about 2 kg, more preferably at least about 5 pounds, (i.e., about 2.3 kg), and most preferably at least about 6 pounds (i.e., about 2.7 kg), and preferably no more than about 3.6 kg and most preferably no more than about 8 pounds (i.e., about 3.6 kg).

In another embodiment shown in FIG. 5, a stabilizing anneal to produce end stock and/or tab stock (that is later coated) is optional. As will be appreciated, heating of the end or tab stock in the coating line can performs the same function as the stabilizing or back anneal.

Figure 5:
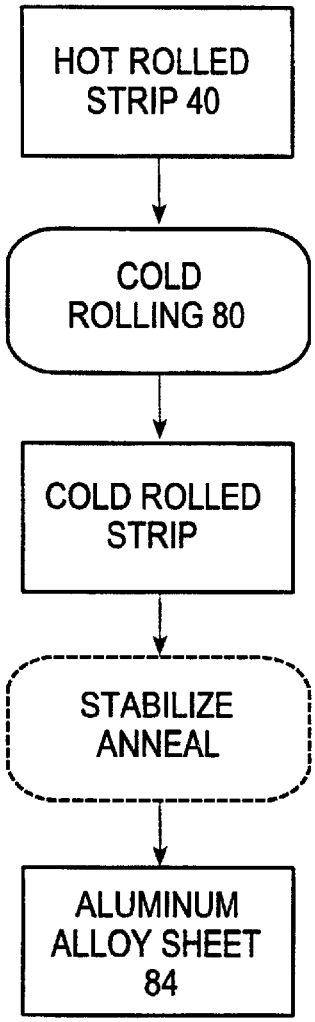

Referring to FIG. 5, the cooled hot rolled strip 40 is subjected to cold rolling 80 to yield aluminum alloy sheet 84. During cold rolling 80, the thickness of the strip is preferably reduced by at least about 70% and more preferably by from about 80 to about 95%. The minimum final gauge of the aluminum alloy sheet 84 is preferably about 0.007 inches, more preferably about 0.095 inches, and most preferably about 0.085 inches, and the maximum final gauge is preferably about 0.012 inches, more preferably about 0.0115 inches, and most preferably about 0.0110 inches.

If a stabilizing anneal is used, the anneal can be performed in a batch or continuous heater (with an induction heater being more preferred) at a temperature preferably ranging from about 250 to about 400° F. (i.e., from about 120 to about 205° C.) and more preferably from about 300 to about 375 F (i.e., from about 145 to about 190° C.) (for a batch heater) and from about 300 to about 500 F. (i.e., from about 145 to about 260 C.) and more preferably from about 400 to about 450 F. (i.e., from about 200 to about 235 C.) (for an induction heater).

An aluminum alloy composition that is particularly useful in this process for tab stock includes:

(i) Manganese, preferably in an amount of at least about 0.05 wt % and no more than about 0.23 wt % and more preferably no more than about 0.15 wt %.

(ii) Magnesium, preferably in an amount of at least about 3.8 wt % and no more than about 4.9 wt %, and most preferably no more than about 4.7 wt %.

(iii) Copper, preferably in amount of at least about 0.05 wt % and no more than about 0.15 wt % and more preferably no more than about 0.10 wt %.

(iv) Iron, preferably in an amount of at least about 0.20 wt % and no more than about 0.35 wt % and more preferably no more than about 0.30 wt %.

(v) Silicon, preferably in an amount of at least about 0.05 wt % and no more than about 0.20 wt % and more preferably no more than about 0.10 wt %.

A most preferred aluminum alloy composition for tab stock includes the following constituents:

(i) Manganese in an amount of at least about 0.05 wt % and no more than about 0.15 wt %.

(ii) Magnesium in an amount of at least about 4.0 wt % and no more than about 4.7 wt %.

(iii) Copper in an amount of at least about 0.05 wt % and no more than about 0.10 wt %.

(iv) Iron in an amount of at least about 0.20 wt % and no more than about 0.30 wt %.

(v) Silicon in an amount of at least about 0.05 wt % and no more than about 0.10 wt %.

An aluminum alloy composition that is particularly useful in this process for the production of end stock includes:

(i) Manganese, preferably in an amount of at least about 0.05 wt % and no more than about 0.20 wt % and more preferably no more than about 0.15 wt %.

(ii) Magnesium, preferably in an amount of at least about 3.8 wt % and more preferably at least about 4.0 wt %, and no more than about 5.2 wt %, and more preferably no more than about 4.7 wt %.

(iii) Copper, preferably in amount of at least about 0.05 wt % and no more than about 0.15 wt % and more preferably no more than about 0.10 wt %.

(iv) Iron, preferably in an amount of at least about 0.20 wt % and no more than about 0.35 wt % and more preferably no more than about 0.30 wt %.

(v) Silicon, preferably in an amount of at least about 0.05 wt % and no more than about 0.20 wt % and more preferably no more than about 0.15 wt %.

A most preferred aluminum alloy composition for end stock includes the following constituents:

(i) Manganese in an amount of at least about 0.05 wt % and no more than about 0.15 wt %.

(ii) Magnesium in an amount of at least 3.8 wt % and no more than about 5.0 wt %.

(iii) Copper in an amount of at least about 0.05 wt % and no more than about 0.10 wt %.

(iv) Iron in an amount of at least about 0.20 wt % and no more than about 0.30 wt %.

(v) Silicon in an amount of at least about 0.05 wt % and no more than about 0.15 wt %.

The aluminum alloy sheet 84 has properties that are particularly useful for end stock. The aluminum alloy sheet 84 preferably has an after-coated yield strength of at least about 41 ksi, more preferably at least about 47 ksi, and most preferably at least about 47.5 ksi. The aluminum alloy sheet 84 preferably has an after-coated ultimate tensile strength of at least about 49 ksi and more preferably at least about 51 ksi and most preferably at least about 53 ksi and of no more than about 55 ksi and most preferably no more than about 60 ksi. The aluminum alloy sheet 84 preferably has an elongation of at least about 3% and most preferably at least about 6% and of no more than about 8%.

Figure 6:
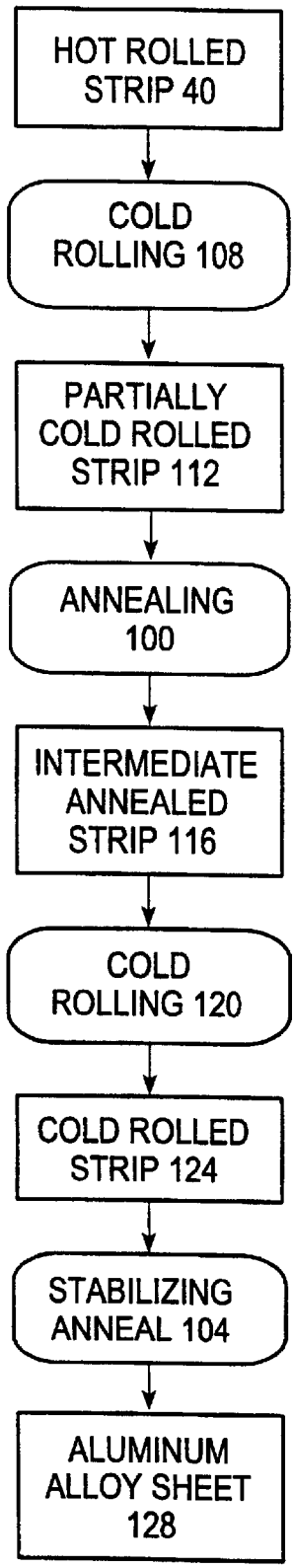

In yet another embodiment shown in FIG. 6, the further treating steps 44 include both an intermediate anneal 100 and a stabilizing anneal 104 to produce body stock. The time and temperature of the stabilizing or back anneal determine the properties of the body stock.

Referring again to FIG. 6, the cooled hot rolled strip 40 is subjected to cold rolling 108 to form a partially cold rolled strip 112. During cold rolling 108, the thickness of the strip is preferably reduced by at least about 40% and more preferably by at least about 45% and most preferably by at least about 50% and no more than about 70% and most preferably no more than about 65%. The minimum gauge of the partially cold rolled strip 112 is preferably at least about 0.012 inches and more preferably at least about 0.015 inches, and the maximum gauge is preferably no more than about 0.035 and more preferably no more than about 0.030 inches. The reductions are performed in 1 pass through rotating cold rollers.

The partially cold rolled strip 112 is subjected to an intermediate annealing step 100 to form an intermediate annealed strip 116 having reduced residual cold work and less earing. In the intermediate annealing step 100, a continuous or batch heater can be employed, with a continuous heater such as an induction heater being most preferred.

The temperature of the intermediate anneal depends upon the type of furnace employed. The temperature and duration of the anneal using a continuous heater are discussed above. For a batch heater, the strip 112 is preferably intermediate annealed at a minimum temperature of at least about 650° F. (i.e., about 343° C.), and preferably at a maximum temperature of no more than about 900° F. (i.e., about 482° C.) for a soak time ranging from about 2 to about 3 hrs.

The intermediate annealed strip 116 is subjected to further cold rolling 120 to form the cold rolled strip 124. The amount of reduction in the cold rolling step 120 depends on the final gauge of the cold rolled strip 124 and the gauge of the partially cold rolled strip 112. Preferably, the final gauge of the aluminum alloy sheet 128 is at least about 0.009 inches, more preferably at least about 0.010 inches and no more than about 0.013 inches and more preferably no more than about 0.125 inches. In a preferred embodiment, the cold mill reduction in the cold rolling step 120 is from about 40 to about 65%. The cold rolling step is preferably performed in 1 pass.

The cold rolled strip 124 is subjected to a stabilizing anneal 104 to form the aluminum alloy sheet 128. Although any heater can be employed in the stabilizing anneal, it is most preferred that a continuous (e.g., induction) heater be used if a continuous (e.g., induction) heater were employed in the intermediate annealing step 100. The temperature and duration of a stabilizing anneal 104 utilizing an induction heater is discussed in detail above. For a batch heater, the annealing temperature ranges from about 300 to about 450° F. for a soak time ranging from about 2 to about 3 hrs.

Aluminum alloy sheet 128 is particularly useful as body stock. An aluminum alloy composition that is particularly useful in this process for body stock includes:

(i) Manganese, preferably in an amount of at least about 0.85 wt % and more preferably at least about 0.9 wt % and of no more than about 1.2 wt % and more preferably no more than about 1.1 wt %.

(ii) Magnesium, preferably in an amount of at least about 0.9 wt % and more preferably at least about 1.0 wt % and of no more than about 1.5 wt %.

(iii) Copper, preferably in amount of at least about 0.05 wt % and more preferably at least about 0.20 wt % and no more than about 0.50 wt %.

(iv) Iron, preferably in an amount of at least about 0.05 wt % and more preferably of at least about 0.35 wt % and of no more than about 0.60 wt %.

(v) Silicon, preferably in an amount of at least about 0.05 wt % and more preferably of at least about 0.3 wt % and of no more than about 0.5 wt % and more preferably no more than about 0.4 wt %.

A most preferred aluminum alloy composition for body stock includes the following constituents:

(i) Manganese in an amount of at least about 0.85 wt % and no more than about 1.1 wt %.

(ii) Magnesium in an amount of at least about 0.10 wt % and no more than about 1.5 wt %.

(iii) Copper in an amount of at least about 0.35 wt % and no more than about 0.50 wt %.

(iv) Iron in an amount of at least about 0.35 wt % and no more than about 0.60 wt %.

(v) Silicon in an amount of at least about 0.2 wt % and no more than about 0.4 wt %.

The various alloying elements are believed to account partly for the superior properties of the aluminum alloy sheet of the present invention. Without wishing to be bound by any theory, magnesium and manganese are believed to increase the ultimate and yield tensile strengths; copper is believed to retard after-bake drops in mechanical properties for body stock; iron is believed not only to provide increased ultimate and yield tensile strengths but also to provide a smaller grain size; and silicon is believed to provide a larger alpha phase transformation particle size which helps inhibit galling/scoring in the body maker operation.

The aluminum alloy sheet has properties that are particularly useful for body stock. When the aluminum alloy sheet is to be used as body stock, the alloy sheet preferably has an as rolled tensile strength of at least about 40 ksi, more preferably at least about 42 ksi, and most preferably at least about 42.5 ksi and of no more than about 47 ksi, more preferably no more than about 46 ksi, and most preferably no more than about 45 ksi. The as-rolled yield strength preferably is at least about 37 ksi, more preferably at least about 38 ksi, and most preferably at least about 39 ksi and no more than about 43 ksi, more preferably no more than about 42 ksi, and most preferably no more than about 41 ksi. The aluminum alloy sheet 128 preferably has an elongation of at least about 3% and most preferably at least about 4% and of no more than about 10% and most preferably no more than about 8%.

To produce acceptable drawn and ironed container bodies, aluminum alloy sheet 128 used as body stock should have a low earing percentage. The earing should be such that the bodies can be conveyed on the conveying equipment and the earing should not be so great as to prevent acceptable handling and trimming of the container bodies. Preferably, the aluminum alloy sheet 128, according to the present invention, has a tested earing of no more than about 2.0% and more preferably no more than about 1.9% and most preferably no more than about 1.8%.

Container bodies fabricated from the aluminum alloy sheet 128 of the embodiment of the present invention have relatively high strengths. The container bodies have a minimum dome reversal strength (or minimum buckle strength) of about 90 psi and more preferably at least about 93 psi and a maximum dome reversal strength (or maximum buckle strength) of no more than about 98 psi at current commercial thicknesses. The column strength of the container bodies is preferably at least about 180 psi and most preferably at least about 210 psi and no more than about 280 psi and most preferably no more than about 260 psi.

The relatively low earing and high strength properties are readily realized due to the ability of the properties of the cold rolled strip to be varied with anneal time and temperature. The direct relationship between the strip's strength properties on the one hand and the time and temperature of the stabilize anneal on the other permits the physical properties of the aluminum alloy sheet to be selectively controlled. Because earing is directly related to the amount of cold rolling reduction performed, the cold rolling step 120 can use a relatively low amount of cold rolling reduction to realize an acceptable earing. Preferably, at least about 30% of the total gauge reduction attributable to cold rolling is performed in the cold rolling step 108. Because the reduced amount of cold rolling means less work hardening and therefore lower strength properties, the stabilization anneal is used to improve the strength properties to the desired levels.

Figure 7:
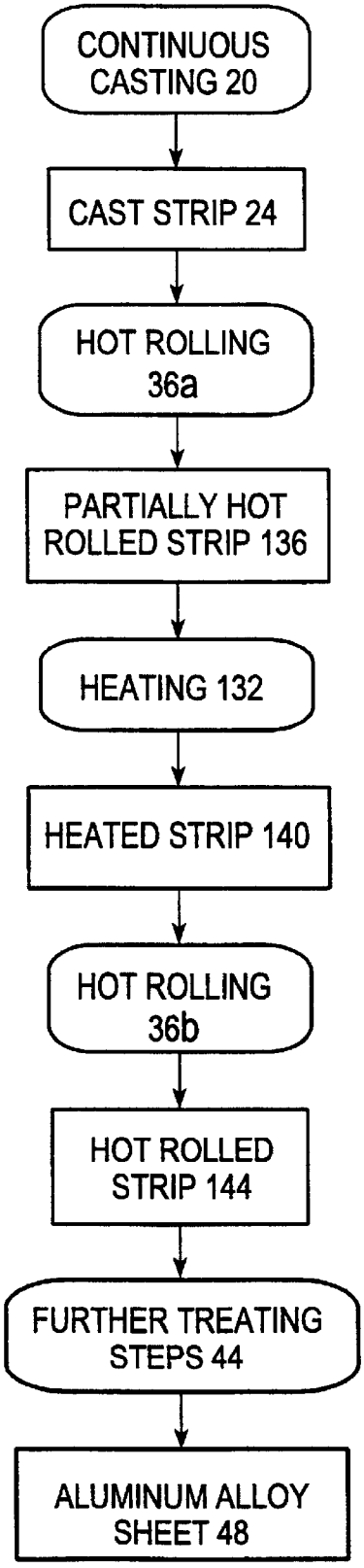
FIG. 7 is a block diagram illustrating yet another embodiment of a process according to the present invention.

FIG. 7 depicts an alternative configuration for body stock to that shown in FIGS. 3 and 6. As shown in FIG. 7, the heating step 132 is performed during (but not after) hot rolling. As will be appreciated, this configuration can be combined with any of the embodiments for the further treating steps 44 shown in FIGS. 4–6.

Referring to FIG. 7, the heating step 132 is performed between one or more pairs of hot rolling stands. This will typically be between the first and second hot rolling stands to elevate the temperature of the strip, during hot milling, to a level above the heater input temperature of the strip. Thus, the cast strip 24 is hot rolled 36*a* to form a partially hot rolled strip 136, heated 132 to form a heated strip 140, and hot rolled 36*b* to form a hot rolled strip 144. The preferred temperature in the heating step ranges from about 750 to about 850° F. (i.e., about 399 to about 454° C.). In this configuration, the cast strip 24 is preferably not annealed or otherwise heated prior to the first hot rolling stand.

The above-noted processes employed for end and body stock can be employed with some modification to produce sheet for other applications. By way of example, the sheet can be used to fabricate foil products such as cooler fins. The preferred alloy composition for such sheet is as follows:

(i) Manganese in an amount of no more than about 0.05 wt %.

(ii) Magnesium in an amount ranging from about 0.05 to about 0.10 wt %.

(iii) Copper in an amount ranging from about 0.05 to about 0.10 wt %.

(iv) Iron in an amount ranging from about 0.4 to about 1.0 wt %.

(v) Silicon in an amount ranging from about 0.3 to about 1.1 wt %.

Figure 8:
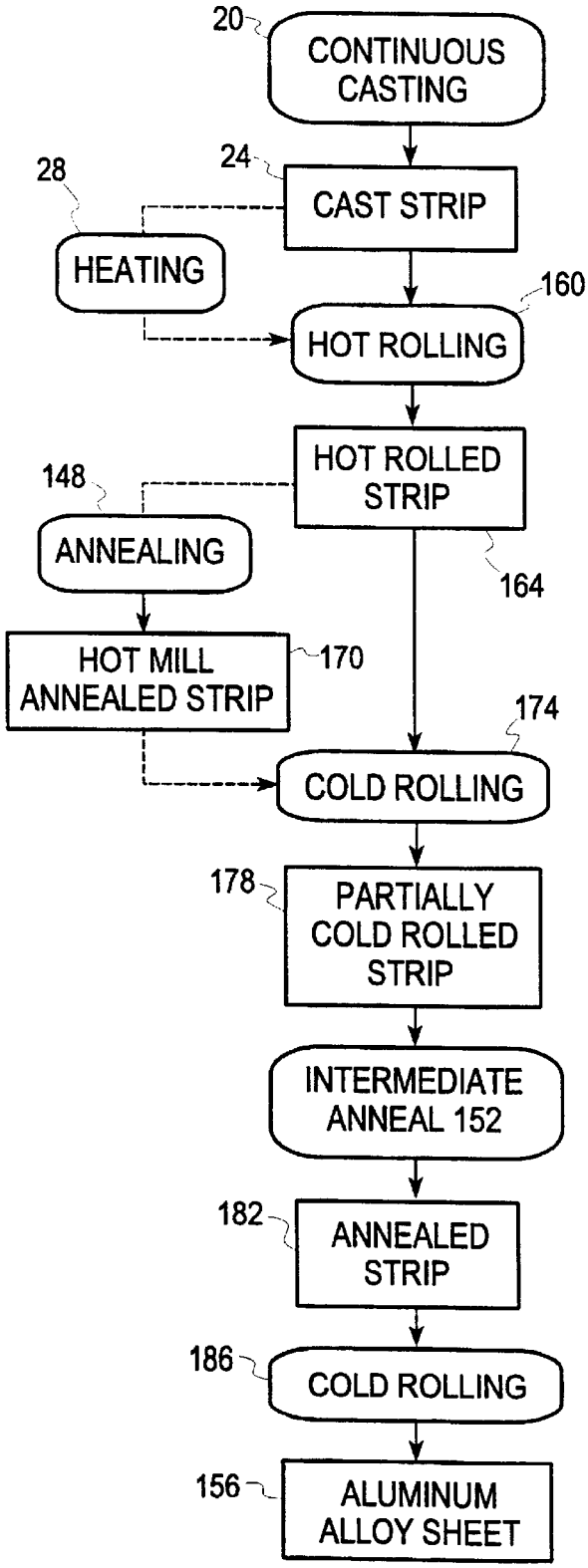
FIG. 8 is a block diagram depicting a further embodiment of a process according to the present invention.

FIG. 8 depicts yet another embodiment of a process according to the subject invention. In this embodiment, the process includes an optional heating step 28 before or during hot rolling, an optional hot mill annealing step 148, and an intermediate annealing step 152. Best results are realized for a batch intermediate anneal if both a batch hot mill anneal and continuous heating, before the last hot rolling stand, are employed, and for an intermediate anneal using an induction heater if no hot mill anneal and only continuous heating before the last hot rolling stand is employed. This process produces aluminum sheet 156 having superior physical properties that is particularly useful for body stock.

Referring to FIG. 8, a melt of the aluminum alloy composition is formed and continuously cast 20 to provide a cast strip 24. The nozzle tip size preferably ranges from about 10 to about 25 mm and more preferably from about 10 to about 18.0 mm, with a maximum tip size of 17.5 mm being most preferred, and the cast strip 24 is hot rolled 160 to form a hot rolled strip 164. The cast strip 24 can optionally be subjected to a heating step 28 as noted above to provide a more equiaxed grain structure in the strip. In the hot rolling step 160, the cast strip 24 is preferably reduced in thickness by an amount of at least about 80%, more preferably at least about 84%, and most preferably at least about 88% but no more than about 94%, more preferably no more than about 94%, and most preferably no more than about 94% to a gauge preferably ranging from about 0.065 to about 0.105 inches.

The hot rolled strip 164 is hot mill annealed 148 in a batch or continuous heater. The continuous heater can be a gas-fired, infrared, or an induction heater.

The temperature and duration of the anneal depend upon the type of furnace employed. The strip is preferably intermediate annealed at a minimum temperature of at least about 650° F. (i.e., about 343° C.), and preferably at a maximum temperature of no more than about 900° F. (i.e., about 482° C.). For continuous heaters, the annealing time for any portion of the strip is preferably a maximum of about 2.5 minutes, more preferably about 30 seconds, and most preferably about 20 seconds and a minimum of about 2 seconds. For batch heaters, the annealing time is preferably a minimum of about 2 hours and is preferably a maximum of about 3 hours.

Referring again to FIG. 8, the hot mill anneal strip 170 is allowed to cool and then subjected to cold rolling 174 to form a partially cold rolled strip 178. During cold rolling 174, the thickness of the strip 170 is reduced by at least about 40% and more preferably at least about 50% but no more than about 70% and more preferably no more than about 65%. Preferably, the reduction to intermediate gauge is performed in 1 to 2 passes. The minimum gauge of the partially cold rolled strip 178 is preferably about 0.012 inches and more preferably about 0.0115 inches, and the maximum gauge is preferably about 0.035 inches and more preferably about 0.030 inches.

The partially cold rolled strip 178 is intermediate annealed 152 to form an annealed strip 182. The intermediate annealing step 152 can be performed in a continuous or batch heater. The preferred continuous heater is an induction heater, with a transflux induction heater being most preferred. The duration and temperature of the anneal 152 using an induction heater preferably are set forth above. For a batch heater, the strip 178 is preferably intermediate annealed 152 at a minimum temperature of at least about 650° F. (i.e., about 343° C.), and preferably at a maximum temperature of no more than about 900° F. (i.e., about 482° C.). The annealing time for a batch heater preferably ranges from about 2 to about 3 hours.

The annealed strip 182 is preferably not rapidly cooled, such as by quenching, after the annealing step or solution heat treated.

The annealed strip 182 is allowed to cool and subjected to cold rolling 186 to form aluminum alloy sheet 156. Preferably, the partially cold rolled strip 178 is reduced in thickness by an amount of at least about 40% and more preferably at least about 50% but no more than about 70% and more preferably no more than about 65% to a gauge ranging from about 0.009 to about 0.013 inches in one pass.

An aluminum alloy composition that is particularly useful for body stock in this embodiment includes:

(i) Manganese, preferably in an amount of at least about 0.85 wt % and more preferably at least about 0.9 wt % but no more than about 1.2 wt % and more preferably no more than about 1.1 wt %.

(ii) Magnesium, preferably in an amount of at least about 0.9 wt % and more preferably at least about 1.0 wt % but no more than about 1.5 wt %.

(iii) Copper, preferably in amount of at least about 0.20 wt % but no more than about 0.50 wt %.

(iv) Iron, preferably in an amount of at least about 0.35 wt % but no more than about 0.50 wt % and more preferably no more than about 0.60 wt %.

(v) Silicon, preferably in an amount of at least about 0.3 wt % but no more than about 0.5 wt % and more preferably no more than about 0.4 wt %.

A particularly useful aluminum alloy composition for body stock using this process includes the following constituents:

(i) Manganese in an amount of at least about 0.85 but no more than about 1.1 wt %.

(ii) Magnesium in an amount of at least about 0.10 but no more than about 1.5 wt %.

(iii) Copper in an amount of at least about 0.35 but no more than about 0.50 wt %.

(iv) Iron in an amount of at least about 0.35 but no more than about 0.60 wt %.

(v) Silicon in an amount of at least about 0.2 but no more than about 0.4 wt %.

The aluminum alloy sheet has properties that are particularly useful for body stock. When the aluminum alloy sheet is to be used as body stock, the alloy sheet preferably has an as-rolled yield strength of at least about 37 ksi and more preferably at least about 38 ksi, and most preferably at least about 39 ksi but no more than about 43 ksi and more preferably no more than about 42 ksi, and most preferably no more than about 41 ksi. The as-rolled tensile strength preferably is at least about 40 ksi, more preferably at least about 42 ksi, and most preferably at least about 42.5 ksi but no more than about 47 ksi, more preferably no more than about 46 ksi, and most preferably no more than about 45 ksi. The aluminum alloy sheet 128 should have an elongation of at least about 3% and more preferably at least about 4%.

To produce acceptable drawn and ironed container bodies, aluminum alloy sheet 128 used as body stock should have a low earing percentage. Preferably, the aluminum alloy sheet 128, according to the present invention, has a tested earing of no more than about 2.0% and more preferably no more than about 1.9% and most preferably no more than about 1.8%.

Container bodies fabricated from the aluminum alloy sheet 128 of the embodiment of the present invention have relatively high strengths. The container bodies have a minimum dome reversal strength of at least about 90 psi and more preferably at least about 93 psi at current commercial thicknesses. The column strength of the container bodies preferably is at least about 200 psi and more preferably at least about 230 psi.

Figure 9:
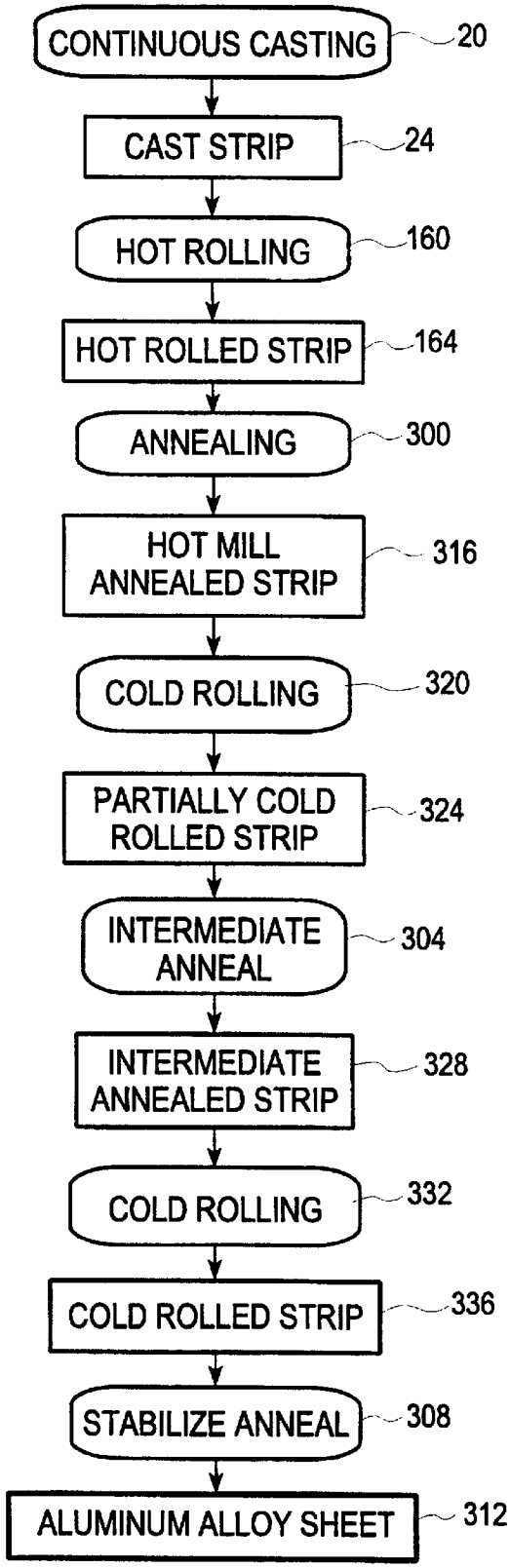
FIG. 9 is a block diagram depicting a further embodiment of a process according to the present invention.

FIG. 9 depicts yet another embodiment of a process that is particularly useful for producing body stock. In this embodiment, the process includes no heating step before or during hot rolling, a hot mill annealing step 300, an intermediate annealing step 304, and a stabilize annealing step 308. This process produces aluminum sheet 312 having superior physical properties that is particularly useful for body stock. It has been discovered that this process can produce aluminum alloy sheet 312 having a relatively low earing; can avoid work hardening during fabrication of the sheet (by a bodymaker) into container bodies and thereby inhibit split flanges and incomplete trim off bodymakers and increase physical properties (i.e., the as-rolled yield and tensile strengths) by varying the soak time and temperature of the stabilize anneal 308.

The relationship between stabilize anneal soak time and temperature and the physical properties of the sheet 312 is believed to be the result of the chemistry and the relatively fine grain size of the sheet 312. The grain size is particularly fine for an induction heater in the intermediate annealing step. The relationship is surprising and unexpected for a sheet having the above-described chemistry. The process permits sheet to be produced according to a variety of differing specifications simply by altering the soak time and/or temperature of the stabilize anneal.

Referring to FIG. 9, a melt of the aluminum alloy composition is formed and continuously cast 20 to provide a cast strip 24. The nozzle tip size preferably ranges from about 10 to about 25 mm and more preferably from about 10 to about 20 mm, with a maximum tip size of 17.5 mm being most preferred. The reduction in tip size to 17.5 mm or less can provide an reduction in the tested earing for the sheet 312 of 0.2% or more and obtain an increase of 1 Ksi in tensile and yield strength relative to aluminum alloy sheet produced by other processes.

The cast strip 24 is hot rolled 160 to form a hot rolled strip 164. In the hot rolling step 160, the cast strip 24 is preferably reduced in thickness by an amount of at least about 50%, more preferably at least about 55%, and most preferably at least about 68% but no more than about 45%, more preferably no more than about 90%, and most preferably no more than about 95% to a gauge preferably ranging from about 0.065 to about 0.120 inches and more preferably from about 0.085 to about 0.110 inches. The lowering of the gauge of the hot rolled strip from 0.105 inches to the range of about 0.065 to about 0.090 can provide further reductions in the tested earing of the sheet 312, improved surface grain size, and increased strength properties.

The hot rolled strip 164 is hot mill annealed 300 in a batch or continuous heater to form a hot mill annealed strip 316. The continuous heater can be a gas-fired, infrared, or an induction heater.

The temperature and duration of the anneal depend upon the type of furnace employed. The strip is preferably intermediate annealed at a minimum temperature of about 650° F. (i.e., about 343° C.) and more preferably about 700° F. (i.e., about 371° C.), and preferably at a maximum temperature of about 900° F. (i.e., about 482° C.) and more preferably of no more than about 850° F. (i.e., about 454° C.). For an induction heater, the minimum temperature is preferably about 900° F., and the maximum temperature is preferably about 1,000° F. For continuous heaters, the annealing time for any portion of the strip is preferably a maximum of about 1 minute, more preferably about 30 seconds, and most preferably about 20 seconds and a minimum of about 2 seconds. For batch heaters, the annealing time is preferably a minimum of about 2 hours and is preferably a maximum of about 3 hours.

Referring again to FIG. 9, the hot mill annealed strip 316 is allowed to cool and then subjected to cold rolling 320 to form a partially cold rolled strip 324. In the cold rolling step 320, the thickness of the strip 316 is preferably reduced by at least about 50% and more preferably at least about 60% but no more than about 70% and more preferably no more than about 65%. Preferably, the reduction to intermediate gauge is performed in 1 to 2 passes. The minimum gauge of the partially cold rolled strip 324 is preferably about 0.013 inches, and the maximum gauge is preferably about 0.030 inches.

The partially cold rolled strip 324 is intermediate annealed 304 to form an intermediate annealed strip 328. The intermediate annealing step 304 can be performed in a continuous or batch heater. The preferred continuous heater is an induction heater, with a transflux induction heater being most preferred. The minimum temperature of the anneal 304 using an induction heater preferably is about 750° F., more preferably about 800° F., and most preferably about 950° F. The maximum temperature of the anneal 304 is preferably about 1,050° F., more preferably about 1,000° F., and most preferably about 1,020° F. The duration of the anneal is as set forth above. For a batch heater, the strip 324 is preferably intermediate annealed 304 at a minimum temperature of at least about 650° F. (i.e., about 343° C.) and more preferably at least about 825° F. (i.e., about 440° C.), and preferably at a maximum temperature of no more than about 900° F. (i.e., about 482° C.) and more preferably of no more than about 1,000° F. (i.e., about 537° C.). The soak time at the annealing temperature for a batch heater preferably ranges from about 2 to about 3 hours and for a continuous heater, particularly an induction heater, from about 2 to about 30 seconds.

The annealed strip 328 can be cooled, such as by quenching, and/or a nitrogen purge, after annealing.

After cooling, the annealed strip 328 is subjected to cold rolling 332 to form cold rolled strip 336. The amount of reduction in cold rolling depends upon the type of heater used in the intermediate anneal 304. For a continuous heater, particularly an induction heater, the preferred reduction in thickness of the annealed strip 328 is at least about 20% and more preferably at least about 25% but no more than about 55% and more preferably no more than about 60% and more preferably no more than about 65% to a gauge ranging from about 0.013 to about 0.009 inches in one pass. For a batch heater, the preferred reduction in thickness of the strip 328 is at least about 40% and more preferably at least about 50% but no more than about 70% and more preferably no more than about 65% to a gauge ranging from about 0.013 to about 0.009 inches in one pass. An annealed strip 328 that has been intermediate annealed in an induction heater is much more sensitive to increases in earing from subsequent cold work than an annealed strip 328 that has been intermediate annealed in a batch heater. Accordingly, cold rolling reductions for induction annealed strips are less than those for batch annealed strips. The cold rolled strip 336 is subjected to a stabilize anneal 308 to form aluminum alloy sheet 312. A batch or continuous heater can be employed in the stabilize anneal 308. The cold rolled strip 336 is preferably stabilize annealed 308 at a minimum temperature of at least about 300° F. (i.e., about 146° C.) and more preferably at least about 325° F. (i.e., about 162° C.), and preferably at a maximum temperature of no more than about 500° F. (i.e., about 260° C.) and more preferably of no more than about 550° F. (i.e., about 287° C.). The most preferred temperature is about 350° F. (i.e., about 176° C.). The annealing time for a batch heater preferably ranges from about 2 to about 3 hours and for a continuous heater, particularly an induction heater, from about 2 to about 30 seconds.

An aluminum alloy composition that is particularly useful for body stock in this embodiment includes:

(i) Manganese, preferably in an amount of at least about 0.85 wt %, more preferably at least about 0.9 wt %, and most preferably at least about 0.95 wt % but no more than about 1.2 wt %, more preferably no more than about 1.1 wt %, and most preferably no more than about 1.1 wt %.

(ii) Magnesium, preferably in an amount of at least about 0.9 wt %, more preferably at least about 1.0 wt %, and most preferably at least about 1.0 wt % but preferably no more than about 1.5 wt %, more preferably no more than about 1.4 wt %, and most preferably no more than about 1.35 wt %.

(iii) Copper, preferably in amount of at least about 0.20 wt %, and more preferably at least about 0.40 wt % but preferably no more than about 0.60 wt % and more preferably no more than about 0.55 wt %.

(iv) Iron, preferably in an amount of at least about 0.35 wt % and more preferably at least about 0.40 wt % but preferably no more than about 0.50 wt % and more preferably no more than about 0.60 wt %.

(v) Silicon, preferably in an amount of at least about 0.3 wt % but no more than about 0.5 wt % and more preferably no more than about 0.4 wt %.

A particularly useful aluminum alloy composition for body stock using this process includes the following constituents:

(i) Manganese in an amount of at least about 0.85 but no more than about 1.2 wt %.

(ii) Magnesium in an amount of at least about 0.85 but no more than about 1.5 wt %.

(iii) Copper in an amount of at least about 0.20 but no more than about 0.60 wt %.

(iv) Iron in an amount of at least about 0.20 but no more than about 0.60 wt %.

(v) Silicon in an amount of at least about 0.30 but no more than about 0.50 wt %.

The aluminum alloy sheet 312 has properties that are particularly useful for body stock. When the aluminum alloy sheet 312 is to be used as body stock, the alloy sheet preferably has a final yield strength of at least about 37 ksi and more preferably at least about 37.5 ksi, and most preferably at least about 38.5 ksi but no more than about 45 ksi and more preferably no more than about 43 ksi, and most preferably no more than about 42.5 ksi. The final tensile strength preferably is at least about 40 ksi, more preferably at least about 41 ksi, and most preferably at least about 43 ksi but no more than about 47 ksi, more preferably no more than about 46.5 ksi, and most preferably no more than about 46.0 ksi. The aluminum alloy sheet 312 should have a final elongation of at least about 3% and more preferably at least about 4%.

To produce acceptable drawn and ironed container bodies, aluminum alloy sheet 312 used as body stock should have a low earing percentage. Preferably, the aluminum alloy sheet 312, according to the present invention, has a tested earing of no more than about 2.5% and more preferably no more than about 2.2% and most preferably no more than about 2%. An induction heater can provide a lower earing percentage because the induction heater uses a lower reduction in the cold rolling step 332. Preferably, aluminum alloy sheet 312 produced using an induction heater has a tested earing of no more than about 2.0% and more preferably no more than about 1.9%.

Container bodies fabricated from the aluminum alloy sheet 312 of the embodiment of the present invention have relatively high strengths. The container bodies have a minimum dome reversal strength of at least about 90 psi and more preferably at least about 93 psi at current commercial thicknesses. The column strength of the container bodies preferably is at least about 210 psi and more preferably at least about 230 psi.

In accordance with yet another embodiment of the present invention, a method is provided for fabricating an aluminum alloy sheet in which the initial cold rolling step is performed in the absence of an annealing step after hot rolling and before the first cold rolling step and/or in which the reductions in strip thickness between intermediate anneals and after the last intermediate anneal are maintained at or below a specified level to avoid full hard conditions. The first intermediate annealing step is performed after the first cold rolling step, and the second intermediate annealing step is performed after the subsequent cold rolling step. The method generally includes the steps of:

(i) forming an aluminum alloy melt;

(ii) continuously casting the alloy melt to form a cast strip;

(iii) optionally heating the cast strip before hot rolling;

(iv) hot rolling the cast strip to form a hot rolled strip;

(v) cooling the hot rolled strip to a temperature below the recrystallization temperature of the hot rolled strip;

(vi) cold rolling the hot rolled strip to form a partially cold rolled strip;

(vii) annealing, preferably in a batch anneal, the partially cold rolled strip to form a first intermediate annealed strip; and (viii) further cold rolling the first intermediate cold mill strip to form a further cold rolled strip;

(ix) further annealing, either in a continuous or a batch anneal, the further cold rolled strip to form a second intermediate annealed strip; and (x) forming the second intermediate annealed strip into the aluminum alloy sheet. As desired, after annealing step (ix) the second intermediate annealed strip can be further cold rolled and/or stabilize annealed to form the aluminum alloy sheet.

The elimination of the annealing step directly after the hot rolling step and the performance of two separate annealing steps only after cold rolling steps offer a number of advantages, particularly when the resulting sheet is employed in the fabrication of containers such as cans. The containers produced from the aluminum alloy sheet can have a reduced degree of earing and a reduction in the occurrence of split flanges and sidewalls in containers produced from the sheet. The plug diameter can be within an acceptable tolerance of the specified plug diameter. Containers produced from the sheet can have a significantly reduced incidence of bulging in the container necked/flange sidewalls compared to containers produced from aluminum alloy sheet having different compositions and/or produced by other processes. It is believed that the alloy sheet of the present invention typically experiences less work hardening during fabrication of containers from the sheet than other continuously cast alloys and comparable to direct chill or ingot cast sheet. For instance, work hardening can occur when cans come off the canmaker and are heated to elevated temperatures to dry the paint on the can. As noted, the reductions in strip thickness between the two intermediate annealing steps and after the final intermediate annealing step are each maintained below the level required for the strip to realize a full hard state. The annealing of a thinner gauge of sheet (i.e., annealing which is performed only after cold rolling steps) compared to annealing in previous embodiments (i.e., which is performed after casting and before hot rolling and again after cold rolling) increases the amount of reduction which can be satisfactorily achieved with each cold roll pass and thus can eliminate one or more cold rolling passes relative to previous embodiments. Finally, the physical properties of the sheet of this embodiment can experience significantly less reduction during fabrication relative to the reduction in physical properties of other alloy sheets during fabrication. In canmaking applications, for example, existing continuously cast alloy sheets can suffer a reduction in physical properties of as much as 4 lbs or more in buckle strength and 20 lbs or more in column strength, after heating the sheet in deco/IBO ovens.

The aluminum alloy sheet produced by the above-described method can have a number of desirable properties, especially for can making applications. By way of example, the sheet can have an as-rolled ultimate tensile strength of at least about 42.5 ksi; an as-rolled yield tensile strength of at least about 38.5 ksi; an earing ranging of no more than about 2.0%; and/or an as-rolled elongation of more than about 4%.

While not wishing to be bound by any theory, it is believed that the maintenance of all cold mill reductions, e.g., the cold mill reductions between the first and second intermediate annealing steps and after the second intermediate annealing step to produce finished gauge sheet, to levels that are less than that required to realize full hard properties in the sheet during fabrication is an important factor in the improved properties, particularly reduced earing. The present invention maintains total cold mill reductions between the first and second intermediate anneal steps, and after the second intermediate anneal step, preferably less than about 73% to prevent the sheet from acquiring full hard properties. Because of the relatively fine grain size of continuously cast sheet compared to direct chill cast sheet, continuously cast sheet has a significantly higher rate of increase in earing for a given percent reduction in the cold mill.

An aluminum alloy that is particularly useful for this process comprises (a) preferably from about 0.85 to about 1.20 and more preferably from about 0.95 to about 1.10 wt % manganese, (b) preferably from about 0.85 to about 1.50 and more preferably from about 1.3 to about 1.45 wt % magnesium, (c) preferably from about 0.20 to about 0.60 and more preferably from about 0.28 to about 0.40 wt % copper, (d) preferably from about 0.30 to about 0.50 and more preferably from about 0.25 to about 0.35 wt % silicon, and (e) preferably from about 0.20 to about 0.60 and more preferably from about 0.40 to about 0.45 wt % iron, with the balance being aluminum and incidental additional materials and impurities. The incidental additional materials and impurities are preferably limited to about 0.05 wt % each, and the sum total of all incidental additional materials and impurities preferably does not exceed about 0.15 wt %.

The aluminum alloy sheet is preferably made by continuous casting and more preferably by any of the processes described above. Preferably, the sheet has an after-bake yield tensile strength of at least about 37.0 ksi, more preferably at least about 38.0 ksi and more preferably at least about 39.0 ksi. The sheet preferably has an earing of less than about 2.0%, more preferably less than about 1.8% and most preferably no more than about 1.6%. The sheet preferably has an elongation of more than about 4% and more preferably more than about 4.5%. Finally, the sheet preferably has an after-bake ultimate tensile strength of at least about 42.5 ksi, more preferably at least about 43.0 ksi and more preferably at least about 43.5 ksi.

Figure 10:
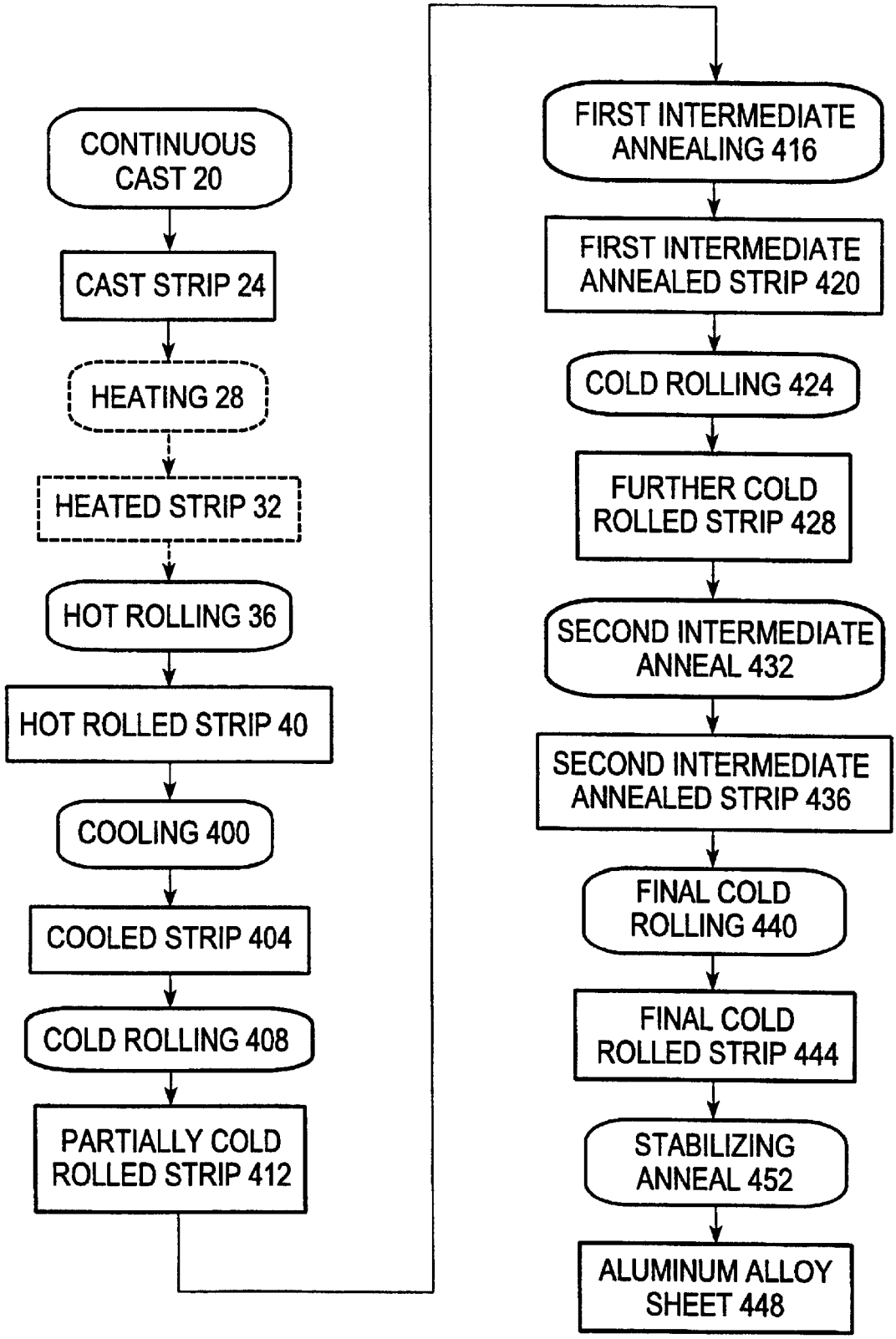
FIG. 10 is a block diagram depicting a further embodiment of a process according to the present invention.

With continuing reference to FIG. 10, in the process the continuously cast strip 24 is produced in a casting cavity having a preferred tip diameter ranging from about 17 to about 19 mm and subjected to hot rolling as described previously to form the hot rolled strip 40. The hot mill preferably reduces the thickness of the cast strip in one or more passes by at least about 70% and more preferably by at least about 80%. The gauge of the cast strip preferably ranges from about 0.50 inches to about 0.95 inches while the gauge of the hot rolled strip ranges from about 0.060 to about 0.140 inches. The hot rolled strip preferably exits the hot mill at a temperature ranging from about 500 to about 750° F. It is preferred that the total reduction of the cast strip be realized in two to three passes with two passes being most preferred.

As an optional step, the continuously cast strip 24 can be heated 28 as described above to form a heated strip 32. The heated strip 32 is then hot rolled 36 to form the hot rolled strip 40.

The hot rolled strip 40 passes directly to a cooling step 400 before the first cold rolling step to form a cooled strip 404. The hot rolled strip 40 is allowed to cool before cold rolling to a temperature less than the recrystallization temperature of the hot rolled strip. Preferably, the hot rolled strip 40 is allowed to cool for a sufficient period of time to produce a hot rolled sheet having a temperature ranging from about 75 to about 140° F. Generally, the hot rolled strip 40 is cooled for about 48 hours. The strip is preferably not quenched or otherwise solution heat treated.

In the first cold rolling step 408, the cooled strip 404 is passed between cold rollers, as necessary, to form a cold rolled strip 412 at an intermediate gauge. Preferably, the intermediate gauge ranges from about 0.050 to about 0.090 inches and more preferably from about 0.055 to about 0.088 inches. The total reduction preferably is less than about 65% and more preferably ranges from about 20% to about 45% and more preferably from about 25 to about 40% through the cold rollers. It is preferred that the total sheet reduction be realized in two passes or less, with a single pass being most preferred.

When the desired intermediate anneal gauge is reached following the first cold rolling step 408, the cold rolled strip 412 is breakdown or first intermediate annealed 416 in a batch anneal oven to form a first intermediate annealed strip 420 and reduce the residual cold work and lower the earing of the aluminum sheet. The first intermediate anneal 416 is preferably a heat soak anneal. Preferably, the strip 412 is intermediate annealed at a minimum temperature of at least about 700° F. and more preferably at a minimum of at least about 800° F., and preferably at a maximum temperature of about 900° F. and most preferably at a maximum temperature of about 850° F. The most preferred annealing temperature is about 825° F. The annealing soak time is preferably a minimum of at least about 0.5 hours and is more preferably a minimum of at least about 1 hour with about 3 hours being most preferred.

Preferably, the first intermediate annealed strip 420 is allowed to cool to a temperature less than the recrystallization temperature of the strip prior to additional cold rolling steps. The preferred temperature for cold rolling ranges from about 75 to about 140° F. The cooling time typically is 48 hours. As will be appreciated, the strip can be force cooled in a significantly shorter time by injecting nitrogen gas into the batch anneal oven to reduce the sheet temperatures to about 250° F. However, the strip is preferably not subjected to solution heat treatment.

After the strip 420 has cooled to ambient temperature, a further cold rolling step 424 is used, as necessary, to form a further cold rolled strip 428 having a smaller intermediate gauge. Preferably, the intermediate gauge ranges from about 0.015 to about 0.040 inches and more preferably from about 0.020 to about 0.030 inches. It is preferred that the thickness of the strip be reduced in total by less than 73%, more preferably by no more than about 71%, and more preferably by no more than about 70%. It is preferred that the total reduction be realized in two passes or less, with a single pass being preferred.

By maintaining all reductions between anneal points below the level necessary to realize full hard conditions (i.e., about 73% or higher), the earing is maintained at relatively low levels. As will be appreciated, the earing of a strip is directly related to the amount of cold work the strip experiences. The reduction in the final cold rolling step is selected to realize the desired strength properties in the final aluminum alloy sheet.

The further cold rolled strip 428 is annealed a second time or second intermediate annealed 432, preferably in a continuous or batch anneal oven, to form a second intermediate annealed strip 436. The anneal can be a heat soak anneal or a continuous anneal, such as in an induction heater. Preferably, the annealing temperature for a batch heater ranges from about 600 to about 900° F., more preferably from about 650 to about 750° F. The most preferred temperature is about 705° F. The annealing or soak time preferably is at least about 0.5 hrs and more preferably about 2 hrs, with about 3 hrs being most preferred. Preferably the annealing temperature for a continuous heater ranges from about 700 F. to about 105° F., with about 950 F. being more preferred. The annealing or soak time preferably ranges from about 2 seconds to about 2.5 minutes and more preferably from about 3 to about 10 seconds.

Preferably, the second intermediate annealed strip 436 is allowed to cool to a temperature less than the recrystallization temperature of the strip prior to a final cold rolling step 440. The preferred temperature for cold rolling ranges from about 75 to about 140° F. The cooling time typically is about 48 hours. As will be appreciated, the strip can be force cooled in a significantly shorter time by injecting the nitrogen gas into the batch annealing oven to reduce the sheet temperatures to about 250° F. However, the strip is preferably not subjected to solution heat treatment.

Finally, a final cold rolling step 440 is used to impart the final properties to a final cold rolled strip 444. Generally, the final gauge is specified and therefore the desired percent reduction for the final cold rolling step 440 is determined. The percent reductions in the other cold rolling steps and the hot rolling step are back calculated based upon the final desired gauge. As noted, the back calculation is performed such that the total cold mill reductions before the first intermediate annealing step 416, between the first and second intermediate annealing steps 416 and 432, and after the second intermediate annealing step 432 are each less than the level required to realize full hard conditions.

In a preferred embodiment, the total reduction to final gauge is from about 40% to 70%, more preferably from about 50% to about 60% and most preferably from about 55% to about 65% in the step. Preferably, the reduction is realized through a single pass. When the strip is fabricated for drawn and ironed container bodies, the final gauge can be, for example, from about 0.010 to about 0.014 inches. The final cold rolling step is preferably conducted at a temperature ranging from about 75° F. to about 120° F. (incoming strip temperature)

The process can include a stabilizing anneal step 452 to impart desired properties to the aluminum alloy sheet 448. The stabilizing anneal step 452 can be performed in either a batch or continuous heater. As noted above, the continuous heater can include an induction heater. The temperature for the stabilizing anneal preferably ranges from about 120 to about 205 C. and more preferably from about 145 to about 175 C. (for a batch heater) and preferably ranges from about 145 to about 260 C. and more preferably from about 200 to about 235 C. (for a continuous heater).

The aluminum alloy sheet 448 produced from the above-noted alloy by this process is especially useful for drawn and ironed container bodies. When the aluminum alloy sheet is to be fabricated into drawn and ironed container bodies, the alloy sheet preferably has an as-rolled yield tensile strength of at least about 37.5 ksi, more preferably at least about 38.0 ksi, and most preferably at least about 38.5 ksi. The maximum as-rolled yield tensile strength is no more than about 40.0 ksi. Preferably, the after-bake yield tensile strength is at least about 36.0 ksi, more preferably at least about 37.0 ksi, and most preferably is at least about 38.0 ksi, and preferably is not greater than about 39.5 ksi. The aluminum alloy sheet preferably has an as-rolled ultimate tensile strength of at least about 42.5 ksi, more preferably at least about 43.0 ksi and most preferably at least about 43.5 ksi and preferably less than about 45.0 ksi. The after-bake ultimate tensile strength is preferably at least about 42.5 ksi, more preferably at least about 43.0 ksi and most preferably at least about 43.5 ksi, and preferably not greater than about 44.0 ksi. Preferably, the aluminum alloy sheet has an earing of less than about 2%, more preferably less than about 1.8% and most preferably less than about 1.6%. The earing typically ranges from about 1.5% to about 1.7%. The sheet preferably has an after-bake elongation of at least about 4.5%, more preferably at least about 5.0% and most preferably at least about 5.5%. The sheet preferably has an as-rolled elongation of at least about 4.0%, more preferably at least about 4.5%, and most preferably at least about 5.0%. Further, container bodies fabricated from the alloy of the present invention have a minimum dome reversal strength of at least about 90 psi and more preferably at least about 95 psi at current commercial thickness.

EXAMPLE 1

Tests were conducted to compare sheet produced by a variety of processes including the process of the present invention. The goals of the tests included: (i) determine the feasibility of replacing the hot mill batch anneal using a solenoidal heater located in front of the first hot mill stand to cause self-annealing of the strip after hot milling is complete; (ii) determine the feasibility of replacing the intermediate batch anneal with a continuous anneal using a transflux induction heater (TFIH); and (iii) confirm prior test results that it is possible to eliminate one cold mill pass and hot mill anneal by exiting the hot mill at 0.065 inch gauge. Referring to Tables I and II, samples 29–31, 32–33, 34, 35, 36–37, 38, 39–42, and 43–44 are sample groupings based on the process used to produce the sample. As used in Table VI, "TFIH" refers to a transflux induction heater, "Heater" refers to a continuous solenoidal heater, and "Batch" refers to a batch gas fired heater. The chemical weight percent compositions of the samples are shown in Table I. The composition is the same as that for body stock. The continuous anneal test results, namely earing, ultimate tensile strength, yield tensile strength, and elongation, and process used to produce coils from the samples are presented in Table II for each sample.

TABLE I

| Sample No. | Si (wt %) | Fe (wt %) | Cu (wt %) | Mn (wt %) | Mg (wt %) |
|---|---|---|---|---|---|
| 29 | 0.39 | 0.538 | 0.404 | 1.06 | 1.333 |
| 30 | 0.383 | 0.532 | 0.4 | 1.058 | 1.316 |
| 32 | 0.394 | 0.546 | 0.405 | 1.064 | 1.334 |
| 39 | 0.421 | 0.57 | 0.419 | 1.045 | 1.335 |
| 40 | 0.39 | 0.547 | 0.405 | 1.064 | 1.334 |
| 44 | 0.395 | 0.541 | 0.405 | 1.061 | 1.336 |
| 34 | 0.392 | 0.551 | 0.408 | 1.073 | 1.339 |
| 35 | 0.379 | 0.538 | 0.398 | 1.048 | 1.303 |
| 36 | 0.397 | 0.554 | 0.409 | 1.054 | 1.322 |
| 37 | 0.388 | 0.543 | 0.403 | 1.063 | 1.337 |
| 38 | 0.386 | 0.542 | 0.404 | 1.076 | 1.334 |
| 31 and 41–43 | 0.387 | 0.562 | 0.463 | 1.055 | 1.339 |

TABLE II

| Sample No. | HM gauge (Inches) | Heater on/off | Hot Mill Anneal | CM Pass | Batch Anneal | Intermediate CM Pass | Anneal Batch/TFIH | Finish gauge (Inches) |
|---|---|---|---|---|---|---|---|---|
| 29 | 0.105 | off | none | .062" | yes/825° F. | .025" | Batch | 0.0112 |
| 30 | 0.105 | off | none | .062" | yes/825° F. | .025" | Batch | 0.0112 |
| 31 | 0.105 | Not available | none | .062" | yes/825° F. | .025" | Batch | 0.0112 |
| 32 | 0.105 | off | none | .062" | yes/825° F. | .025" | TFIH | 0.0112 |
| 31 | 0.105 | Not available | none | .062" | yes/825° F. | .025" | TFIH | 0.0112 |
| 39 | 0.105 | off | yes/825° F. | .050" | no | .025" | Batch | 0.0112 |
| 40 | 0.105 | off | yes/825° F. | .050" | no | .025" | Batch | 0.0112 |
| 41 | 0.105 | Not available | yes/825° F. | .045" | no | .025" | Batch | 0.0112 |
| 41 | 0.105 | Not available | yes/825° F. | .045" | no | .025" | Batch | 0.0112 |
| 44 | 0.105 | off | yes/825° F. | .050" | no | .025" | TFIH | 0.0112 |
| 42 | 0.105 | Not available | yes/825° F. | .045" | no | .025" | TFIH | 0.0112 |
| 34 | 0.065 | on | none | none | none | .025" | Batch | 0.0112 |
| 35 | 0.065 | on | none | none | none | .025" | TFIH | 0.0112 |
| 36 | 0.105 | on | none | .050" | none | .025" | Batch | 0.0112 |
| 37 | 0.105 | on | none | .050" | none | .025" | Batch | 0.0112 |
| 38 | 0.105 | on | none | .050" | none | .025" | TFIH | 0.0112 |

For samples 34–38, a solenoidal heater was located before the first stand of the hot mill. The heater raised the tab temperature a maximum of 160° F. at a casting speed of 16.4 fpm and a slab thickness of 19.0 mm. Table VIII illustrates test results for coils produced utilizing this process configuration.

The solenoidal heater was found to have the following advantages: (i) at lower gauges of the cast strip, elimination of the need for a hot mill anneal at 825° F. for 3 hours; (ii) reduction of the hot mill stand amps and loads when the exit gauge from the hot mill is reduced; (iii) increase in the amount of heat transferred to the cast strip when the cast strips are thinner than 19 mm (i.e., thinner cast strips cool more quickly, which can increase the loads and amps and therefore limit the exit gauge that can be realized without applying excessive power to the hot mill); and (iv) removal of striations in the hot mill strip.

As shown in Table VIII, Samples 36–38 produced using the solenoidal heater at the hot mill exit gauge of 0.105-inch gauge were undesirable. Microstructure confirmed that the coils produced using this exit gauge did not recrystallize. This is further confirmed in the final gauge earing/mechanical property data. While not wishing to be bound by any theory, it is believed that the cast strip gauge is too thick for the amount of time available in the solenoidal heater and the power usage. This, in combination with the chemistry of the samples, complicates recrystallization. Another reason could be the higher intrastand gauge of 0.22 mm versus 0.19 mm seen on the 0.65-inch gauge material. The higher intrastand gauge and intrastand temperature maintained the cast strip above the temperature above the recrystallization point before the second hot mill stand.

In the case of coils fabricated using the solenoidal heater and an exit gauge of 0.65 inch, the material reacted as a self-anneal hotband and recrystallized. Referring to Tables VII and VIII, for example, Samples 29 and 34 both recrystallized. Sample 29, which was fabricated without the solenoidal heater, exited the hot mill at 0.105-inch gauge and was cold rolled to 0.062-inch gauge. It then received a batch anneal at 825° F. for 3 hours of soak time, which caused recrystallization. The total anneal cycle time was 12 to 18 hours of soak time. In contrast, Sample 34 exited the hot mill at 0.065-inch gauge with the solenoidal heater at 30% of available power. Sample 34 received no batch anneal after the first cold rolling pass. Unlike Sample 29, which received three cold mill passes, Sample 34 received only two cold mill passes. The data illustrates that when both samples were given a batch anneal at 0.025-inch gauge after the second cold rolling pass and before the finished cold rolling pass, there was a very minor difference in properties.

In short, the minor difference in properties indicates that a solenoidal heater could be placed in front of the hot mill and, using an exit gauge of 0.65 inches or lower, a cold mill pass and the hot mill anneal could both be eliminated while maintaining acceptable properties.

Regarding the comparison of an intermediate batch anneal against an intermediate continuous anneal using an induction heater, Tables II through VIII present the results. The pilot line using the transflux induction heater could only accept a 14.5-inch wide strip and was limited to a maximum of 1,000 lbs. of incoming weight. The TFIH anneal temperature was 950° F. as compared to 705° F. for the batch anneal. The reason for the temperature difference is due to the total exposure time which is considerably less for the TFIH compared to the batch anneal. The total exposure time of the strip in the TFIH was about 2–6 seconds.

It is evident from the Tables that the final earing is aggravated by the use of a continuous intermediate anneal as compared to a batch anneal. The magnitude of the earing varied, depending upon the process used to produce the material.

Figure 11:
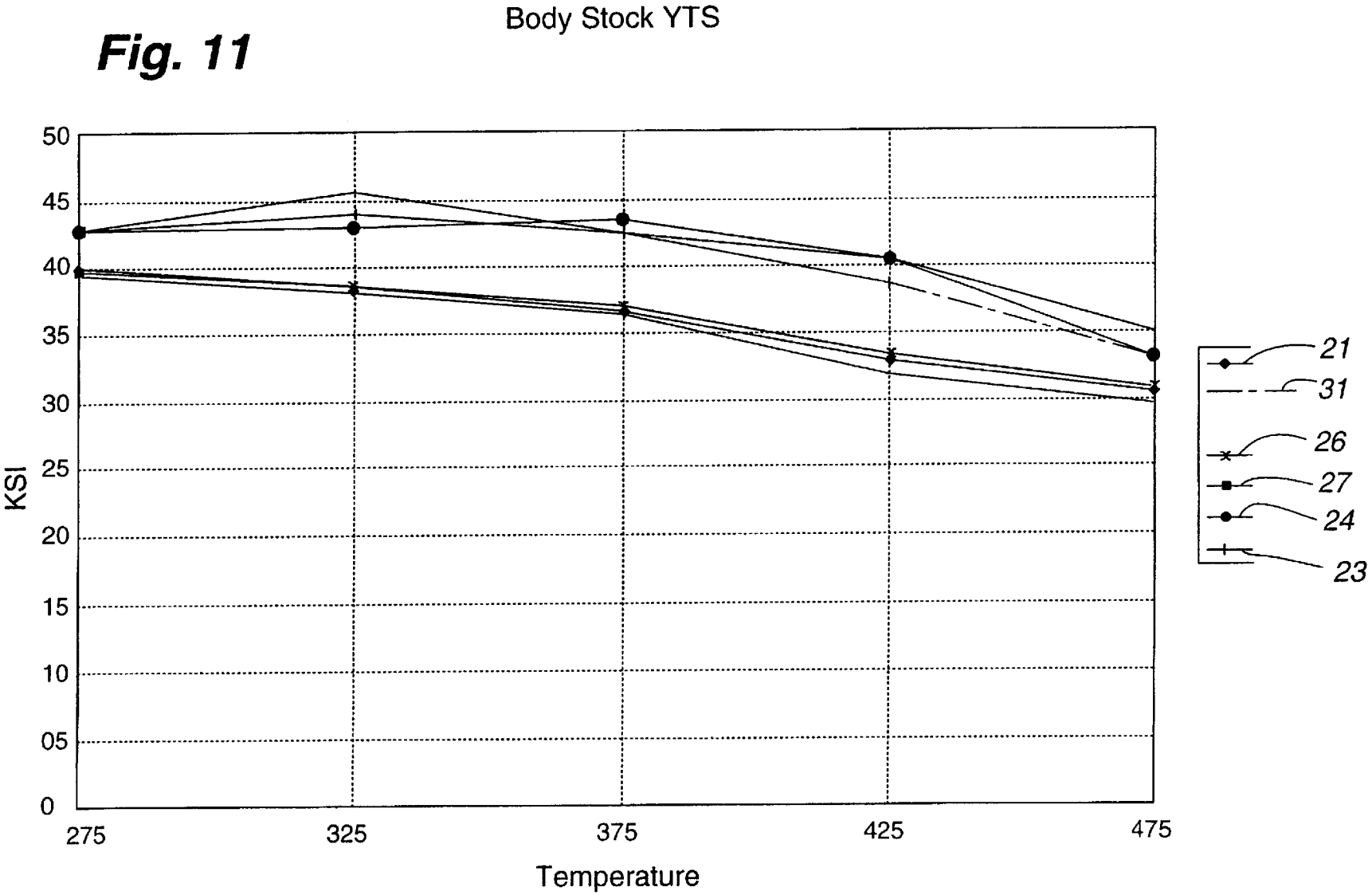
FIGS. 11 and 12 depict test results for various samples.
Figure 12:
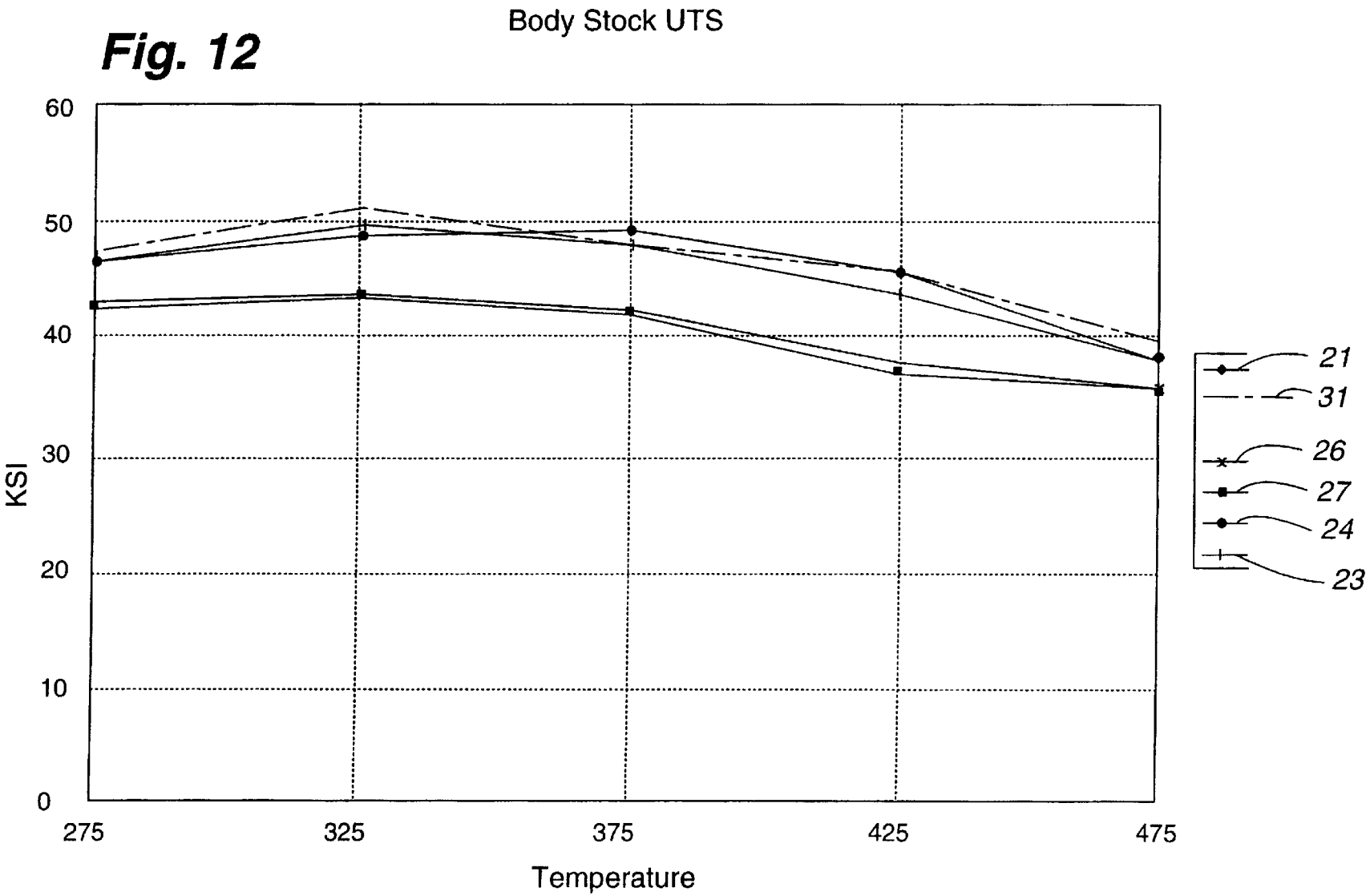

The TFIH increases the as-rolled mechanical properties of the sheet by an average of about 3.0 ksi in tensile strength and 3.5 ksi in yield strength. An important issue is the increase of tensile and yield strengths when the TFIH coils are subjected to further heating. Normally when as-rolled material is heated in the temperature range of 325° to 400° F, the mechanical properties will be decreased significantly in yield strength and slightly in the tensile strength and increased in percent elongation. In the case of the coils produced by a process using a TFIH, tensile and yield strengths and percent elongation are increased as the coils are heated. This phenomena is illustrated in Table VII and FIGS. 11 and 12. The increase in tensile and yield strengths from heating is as much as 5 ksi with a 325° F./1 hour stabilize anneal and 7 ksi with an after-bake temperature of 400° F. for 10 minutes. The increase continues until a stabilized temperature of about 400° F. is realized.

TABLE III

| Sample No. | If "0" heater is off Heater KW* | Caster Exit Temp (° F.) | Heater Entry Temp (° F.) | Heater Exit Temp (° F.) | Inter-stand Temp (° F.) | Hot Mill Exit Temp (° F.) | Hot Mill Stand 1 Amps | Hot Mill Stand 2 Amps | Hot Mill Stand 1 Load | Hot Mill Stand 2 Load | Hot Mill Stand 1 Gauge (Inches) | Hot Mill Stand 2 Gauge (Inches) |
|---|---|---|---|---|---|---|---|---|---|---|---|---|
| 45 | 0 | 1030 | 935 | 904 | 775 | 655 | 1460 | 1290 | 1018 | 970 | 0.225 | 0.105 |
| 46 | 40 | 1025 | 940 | 1004 | 798 | 645 | 1350 | 1210 | 890 | 911 | 0.23 | 0.105 |
| 47 | 30 | 1023 | 958 | 954 | 794 | 717 | 1420 | 1440 | 998 | 1070 | 0.19 | 0.065 |
| 48 | 30 | 1030 | 953 | 959 | 801 | 700 | 1400 | 1460 | 1085 | 1024 | 0.19 | 0.065 |
| 49 | 40 | 1040 | 970 | 984 | 803 | 658 | 1300 | 1210 | 898 | 951 | 0.19 | 0.065 |
| 50 | 40 | 1039 | 963 | 989 | 800 | 652 | 1290 | 1220 | 870 | 943 | 0.22 | 0.105 |
| 51 | 40 | 1034 | 960 | 999 | 799 | 655 | 1280 | 1220 | 896 | 947 | 0.22 | 0.105 |
| 52 | 0 | 1015 | 948 | 911 | 750 | 647 | 1480 | 1250 | 1010 | 982 | 0.22 | 0.105 |
| 53 | 0 | | | 905 | 768 | 652 | 1500 | 1280 | 1049 | 981 | 0.22 | 0.105 |
| 54 | 0 | | 958 | 910 | 767 | 647 | 1490 | 1250 | 1029 | 970 | 0.22 | 0.105 |
| 55 | 0 | | 952 | 908 | 767 | 650 | 1490 | 1260 | 1032 | 985 | 0.22 | 0.105 |
| 56 | 0 | | 960 | 910 | 766 | 645 | 1480 | 1250 | 1022 | 980 | 0.22 | 0.105 |

Caster Speed was 16.4 feet per minute.
Caster tip size was 19 millimeters.

TABLE IV

| Sample No. | | As rolled Uts (ksi) | As rolled YTS (ksi) | As rolled El (%) | 325/hr Uts (ksi) | 325/hr YTS (ksi) | 325/hr El (%) | 400/10 Uts (ksi) | 400/10 YTS (ksi) | 400/10 El (%) | Intermediate Anneal Type |
|---|---|---|---|---|---|---|---|---|---|---|---|
| | Finish Ga Earing (%) | | | | | | | | | | |
| 36 | 2.53 | 43.34 | 41.62 | 2.67 | 44.71 | 39.64 | 5.41 | 43.55 | 37.81 | 5.45 | Batch |
| 37 | 2.88 | 43.62 | 41.83 | 3.14 | 44.69 | 39.91 | 4.69 | 43.2 | 37.94 | 5.5 | Batch |
| Average | 2.71 | 43.48 | 41.73 | 2.91 | 44.70 | 39.78 | 5.05 | 43.38 | 37.88 | 5.48 | |
| | Earing (%) | | | | | | | | | | |
| 34 | 1.72 | 41.94 | 40.12 | 3.26 | 43.71 | 38.6 | 5.58 | 42.47 | 36.9 | 5.48 | Batch |
| 35 | 2.66 | 45.06 | 44.53 | 2.43 | 50.42 | 44.48 | 7.87 | 49.95 | 44.19 | 7.6 | TFIH |
| Diff Samples 34 & 35 | 0.94 | 3.12 | 4.41 | −0.83 | 6.71 | 5.88 | 2.29 | 7.48 | 7.29 | 2.12 | |

TABLE V

| Sample No. | Finish Ga Earing (%) | Surface Grain Rating | As rolled Uts (ksi) | As rolled YTS (ksi) | As rolled El (%) | 325/1 hr. Uts (ksi) | 325/1 hr. YTS (ksi) | 325/1 hr. El (%) | 400/10 Uts (ksi) | 400/10 YTS (ksi) | 400/10 El (%) | 2nd Anneal Gauge (Inches) | 2nd Anneal Type |
|---|---|---|---|---|---|---|---|---|---|---|---|---|---|
| 29 | 1.76 | 3 | 42.8 | 40.78 | 3.63 | 44.19 | 38.84 | 5.35 | 42.75 | 36.89 | 5.78 | 0.025 | Batch |
| 30 | 1.97 | 2.25 | 42.25 | 40.54 | 3.49 | 43.97 | 38.54 | 5.39 | 42.55 | 36.65 | 6.08 | 0.025 | Batch |
| Average 29 & 30 | 1.865 | 2.625 | 42.53 | 40.66 | 3.56 | 44.08 | 38.69 | 5.37 | 42.65 | 36.77 | 5.93 | | |
| 31 | 1.35 | 1.5 | 41.91 | 39.6 | 3.6 | 43.41 | 38.19 | 5.34 | 42.1 | 36.91 | 5.63 | 0.025 | Batch |
| Diff Average 29 & 30 and Sample 31 | −0.515 | −1.125 | −.062 | −1.06 | 0.04 | −0.67 | −0.5 | −0.03 | −0.55 | 0.14 | −0.3 | | |
| 32 | 2.06 | 6 | 45.09 | 43.97 | 2.49 | 49.23 | 43.04 | 7.2 | 47.51 | 41.1 | 7.01 | 0.025 | TFIH |
| 33 | 2.14 | 5 | 44.54 | 43.61 | 2.5 | 48.57 | 42.8 | 6.85 | 48.47 | 42.66 | 7.12 | 0.025 | TFIH |
| Average 32 & 33 | 2.1 | 5.5 | 44.82 | 43.79 | 2.495 | 48.9 | 42.92 | 7.025 | 47.99 | 41.88 | 7.065 | | |
| Diff Samples 32 & 33 | 0.08 | −1 | −0.55 | −0.36 | 0.01 | −0.24 | −0.35 | −0.35 | 0.96 | 1.56 | 0.11 | | |
| Diff Average 29 & 30 and Sample 32 | 0.195 | 3.375 | 2.565 | 3.31 | −1.07 | 5.15 | 4.35 | 1.83 | 4.86 | 4.33 | 1.08 | | |
| Diff Samples 31 and 32 | 0.79 | 3.5 | 2.63 | 4.01 | −1.1 | 5.16 | 4.61 | 1.51 | 6.37 | 5.75 | 1.49 | | |

TABLE VI

| Sample No. | Finish Ga Earing (%) | Surface Grain Rating | As rolled Uts (ksi) | As rolled YTS (ksi) | As rolled El (%) | 325/1 hr. Uts (ksi) | 325/1 hr. YTS (ksi) | 325/1 hr. El (%) | 400/10 Uts (ksi) | 400/10 YTS (ksi) | 400/10 El (%) | 2nd Anneal Gauge (Inches) | 2nd Anneal Type |
|---|---|---|---|---|---|---|---|---|---|---|---|---|---|
| 39 | 1.61 | 3.5 | 41.87 | 40.08 | 3.2 | 43.63 | 38.85 | 5.23 | 42.16 | 36.52 | 5.37 | 0.025 | Batch |
| 40 | 1.68 | 3.5 | 42.17 | 40.59 | 2.86 | 44.05 | 38.67 | 5.97 | 42.86 | 36.95 | 5.91 | 0.025 | Batch |
| Avg. Samples 39 & 40 | 1.65 | 3.50 | 42.02 | 40.34 | 3.03 | 43.84 | 38.76 | 5.60 | 42.51 | 36.74 | 5.64 | | |
| 41 | 1.78 | 4 | 42.18 | 40.58 | 3.34 | 44.22 | 39.01 | 5.74 | 43.04 | 37.23 | 5.84 | 0.025 | Batch |
| 42 | 2.14 | 3.5 | 42.45 | 40.64 | 3.17 | 44.46 | 39.1 | 5.69 | 43.22 | 37.44 | 5.84 | 0.025 | Batch |
| Avg. Samples 41 & 42 | 1.96 | 3.75 | 42.32 | 40.71 | 3.255 | 44.34 | 39.06 | 5.715 | 43.13 | 37.34 | 5.84 | | |
| 43 | 2.58 | 8 | 45.3 | 44.14 | 2.46 | 48.32 | 42.96 | 6.37 | 47.46 | 41.86 | 6.81 | 0.025 | TFIH |
| 44 | 2.58 | 8 | 45.15 | 44.11 | 3.17 | 49.02 | 43 | 6.87 | 48.06 | 42.24 | 7.23 | 0.025 | TFIH |
| Diff Sample 44 & Avg. Samples 38 & 40 | 0.93 | 4.5 | 3.13 | 3.78 | 0.14 | 5.18 | 4.24 | 1.27 | 5.55 | 5.51 | 1.59 | | |
| Diff Sample 43 & Avg. Samples 34 & 35 | 0.62 | 4.25 | 2.985 | 3.43 | −0.8 | 3.98 | 3.905 | 0.655 | 4.33 | 4.525 | 0.97 | | |

TABLE VII

| Sample No. | Finish Ga Earing (%) | Surface Grain Rating | As rolled Uts (ksi) | As rolled YTS (ksi) | As rolled El (%) | 325/1 hrs. Uts (ksi) | 325/1 hrs. YTS (ksi) | 325/1 hrs. El (%) | 400/10 Uts (ksi) | 400/10 YTS (ksi) | 400/10 El (%) | Heater |
|---|---|---|---|---|---|---|---|---|---|---|---|---|
| 29 | 1.76 | 3 | 42.8 | 40.78 | 3.63 | 44.19 | 38.84 | 5.35 | 42.75 | 36.89 | 5.78 | N/A |
| 30 | 1.97 | 2.25 | 42.25 | 40.54 | 3.49 | 43.97 | 38.54 | 5.39 | 42.55 | 36.55 | 6.08 | N/A |
| 31 | 1.35 | 1.5 | 41.91 | 39.6 | 3.6 | 43.41 | 38.19 | 5.34 | 42.1 | 36.91 | 5.63 | N/A |
| 32 | 2.06 | 6 | 45.09 | 43.97 | 2.49 | 49.23 | 43.04 | 7.2 | 47.51 | 41.1 | 7.01 | N/A |
| 33 | 2.14 | 5 | 44.54 | 43.61 | 2.5 | 48.57 | 42.8 | 6.85 | 48.47 | 42.66 | 7.12 | N/A |
| 34 | 1.72 | 3 | 41.94 | 40.12 | 3.26 | 43.71 | 38.6 | 5.58 | 42.47 | 36.9 | 5.48 | Y |
| 35 | 3.04 | 7 | 45.06 | 44.53 | 2.43 | 50.42 | 44.48 | 7.87 | 49.95 | 44.19 | 7.6 | Y |
| 36 | 2.53 | 2.5 | 43.34 | 41.62 | 2.67 | 44.71 | 39.64 | 5.41 | 43.55 | 37.81 | 5.45 | Y |
| 37 | 3.36 | 2.25 | 43.62 | 41.83 | 3.14 | 44.69 | 39.91 | 4.69 | 43.2 | 37.94 | 5.5 | Y |
| 38 | 2.41 | 8 | 47.24 | 45.46 | 3.95 | 52.16 | 46.38 | 8.19 | 50.01 | 44.56 | 7.94 | Y |
| 39 | 1.61 | 3.5 | 41.87 | 40.08 | 3.2 | 43.63 | 38.85 | 5.23 | 42.16 | 36.52 | 5.37 | N/A |
| 40 | 1.68 | 3.5 | 42.17 | 40.59 | 2.86 | 44.05 | 38.67 | 5.97 | 42.86 | 36.95 | 5.91 | N/A |
| 41 | 1.78 | 4 | 42.18 | 40.58 | 3.34 | 44.22 | 39.01 | 5.74 | 43.04 | 37.23 | 5.84 | N/A |
| 42 | 2.14 | 3.5 | 42.45 | 40.64 | 3.17 | 44.46 | 39.1 | 5.69 | 43.22 | 37.44 | 5.84 | N/A |
| 43 | 2.58 | 8 | 45.3 | 44.14 | 2.46 | 48.32 | 42.96 | 6.37 | 47.46 | 41.86 | 6.81 | N/A |
| 44 | 2.58 | 8 | 45.15 | 44.11 | 3.17 | 49.02 | 43 | 6.87 | 48.06 | 42.24 | 7.23 | N/A |

| Sample No. | 1st ANNEAL HM GA (In) | 1st ANNEAL GA (In) | 1st ANNEAL TYPE | 1st ANNEAL TEMP (° F.) | 1st ANNEAL TIME (Hrs.) | 2nd (INTERMEDIATE) ANNEAL GA (In.) | 2nd (INTERMEDIATE) ANNEAL TYPE | 2nd (INTERMEDIATE) ANNEAL TEMP (° F.) | 2nd (INTERMEDIATE) ANNEAL TIME (Hrs = H Sec = S) |
|---|---|---|---|---|---|---|---|---|---|
| 29 | 0.105 | 0.062 | Batch | 825 | 3 | 0.025 | Batch | 705 | 13H |
| 30 | 0.105 | 0.062 | Batch | 825 | 3 | 0.025 | Batch | 705 | 13H |
| 31 | 0.105 | 0.062 | Barch | 825 | 3 | 0.025 | Batch | 705 | 13H |
| 32 | 0.105 | 0.062 | Batch | 825 | 3 | 0.025 | TFIH | 950 | 2S |
| 33 | 0.105 | 0.062 | Batch | 825 | 3 | 0.025 | TFIH | 950 | 2S |
| 34 | 0.065 | 0.065 | N/A | 800 | | 0.025 | Batch | 705 | 13H |
| 35 | 0.065 | 0.065 | N/A | 800 | | 0.025 | TFIH | 950 | 2S |
| 36 | 0.105 | 0.105 | N/A | 800 | | 0.025 | Batch | 705 | 13H |
| 37 | 0.105 | 0.105 | N/A | 800 | | 0.025 | Batch | 705 | 13H |
| 38 | 0.105 | 0.105 | N/A | 800 | | 0.025 | TFIH | 950 | 2S |
| 39 | 0.105 | 0.105 | Batch | 825 | 3 | 0.025 | Batch | 705 | 13H |
| 40 | 0.105 | 0.105 | Batch | 825 | 3 | 0.025 | Batch | 705 | 13H |
| 41 | 0.105 | 0.105 | Batch | 825 | 3 | 0.025 | Batch | 705 | 13H |
| 42 | 0.105 | 0.105 | Batch | 825 | 3 | 0.025 | Batch | 705 | 13H |
| 43 | 0.105 | 0.105 | Batch | 825 | 3 | 0.025 | TFIH | 950 | 2S |
| 44 | 0.105 | 0.105 | Batch | 825 | 3 | 0.025 | TFIH | 950 | 2S |

TABLE VIII

| | Ultimate Tensile Strength (ksi) | | | | | Yield Tensile Strength (ksi) | | | | | % Elongation | | | | | Earing (%) | | |
|---|---|---|---|---|---|---|---|---|---|---|---|---|---|---|---|---|---|---|
| Sample No. | 275° F. | 325° F. | 375° F. | 425° F. | 475° F. | 275° F. | 325° F. | 375° F. | 425° F. | 475° F. | 275° F. | 325° F. | 375° F. | 425° F. | 475° F. | 275° F. | 325° F. | 425° F. |
| 29 | 43.06 | 43.92 | 42.67 | 38.41 | 36.08 | 39.62 | 38.61 | 36.95 | 33.19 | 30.73 | 4.06 | 5.42 | 5.53 | 4.99 | 4.66 | 1.98 | 1.86 | 1.97 |
| 39 | 42.38 | 43.32 | 42.23 | 37.53 | 35.8 | 39.11 | 38.04 | 36.56 | 32.17 | 30.08 | 4.29 | 5.6 | 5.95 | 5.67 | 6.74 | 1.68 | 1.7 | 1.85 |
| 31 | 42.28 | 43.23 | 42.37 | 37.88 | 35.9 | 38.97 | 38.03 | 36.63 | 32.58 | 30.09 | 3.74 | 5.41 | 5.67 | 5.57 | 6.64 | 1.4 | 1.46 | 1.43 |
| 34 | 42.6 | 43.71 | 42.64 | 38.5 | 36.39 | 39.47 | 38.59 | 37.11 | 33.54 | 31.1 | 3.96 | 5.35 | 5.95 | 5.09 | 5.8 | 1.95 | 2.18 | 2.02 |
| 35 | 47.58 | 51.53 | 48.24 | 46.2 | 40.28 | 43.86 | 45.72 | 42.63 | 41.23 | 35.45 | 5.14 | 7.64 | 7.26 | 6.02 | 5.14 | 2.65 | 3.25 | 2.47 |
| 37 | 46.54 | 49.02 | 49.7 | 46.27 | 38.88 | 42.68 | 43.03 | 43.68 | 40.84 | 33.2 | 4.89 | 6.86 | 7.7 | 6.42 | 6.27 | 2.23 | 2.68 | 2.32 |
| 31 | 46.82 | 49.86 | 48.51 | 44.27 | 38.84 | 43.02 | 44.06 | 42.73 | 38.92 | 33.34 | 4.91 | 7.05 | 7.67 | 6.4 | 5.95 | 2.45 | 2.26 | 2.2 |

Based upon the foregoing, the test results indicate that: (i) one cold mill pass and the hot mill anneal can be eliminated by introducing a solenoidal heater and exit strip gauge of 0.65 inch or less with an intermediate batch anneal; and (ii) the TFIH used at the intermediate anneal point (with a 55% final reduction) increases the final earing by at least 0.6%, which is not acceptable. The same process, when introduced to temperatures of 325 to 400° F. increases the overall mechanical properties (i.e., tensile and yield strengths) by 5 to 7 ksi which also is not acceptable in a can plant where the IBO and deco ovens would, in fact, make the can too strong to be necked and flanged.

EXAMPLE 2

Further experiments were performed to examine the properties of aluminum alloy sheet produced according to the process of FIG. 9. Samples 70 and 71 were produced using a tip size of 17.5 mm and a batch heater in the intermediate anneal (with the annealing temperature being 825 F.) while samples 72 and 73 were produced using a tip size of 19.0 mm and a transflux induction heater in the intermediate anneal (with the annealing temperature being 950 F.). All of the samples were produced using a hot rolling reduction of 60%, a hot mill annealing temperature of about 825 F., a cold rolling reduction in the first pass of about 60% and in the second pass of about 50–65%, and a stabilize anneal temperature of about 350 F.

The cold rolling reductions to finish gauge for the samples were different. The reduction for sample 70 was 55%, for sample 71 was 50%, for sample 72 was 30%, and for sample 73 was 35%.

The properties of the samples are as follows:

| Sample 70 | |
|---|---|
| Before Stabilize Anneal | |
| Tensile strength | 41.8 ksi |
| Yield strength | 39.51 ksi |
| Elongation | 3.39% |
| Earing | 1.8% |
| After Stabilize Anneal | |
| Tensile strength | 45.19 |
| Yield strength | 39.49 |
| Elongation | 6.4% |
| **Sample 71** | |
| Before Stabilize Anneal | |
| Tensile strength | 40.49 ksi |
| Yield strength | 38.65 ksi |
| Elongation | 3.33% |
| Earing | 1.7% |
| After Stabilize Anneal | |
| Tensile strength | 44.78 |
| Yield strength | 36.95 |
| Elongation | 6.8% |
| **Sample 72** | |
| Before Stabilize Anneal | |
| Tensile strength | 43.8 ksi |
| Yield strength | 42.78 ksi |
| Elongation | 1.55% |
| Earing | 1.5% |
| After Stabilize Anneal | |
| Tensile strength | 47.82 |
| Yield strength | 41.75 |
| Elongation | 7.24% |
| **Sample 73** | |
| Before Stabilize Anneal | |
| Tensile strength | 44.46 ksi |
| Yield strength | 41.13 ksi |
| Elongation | 4.51% |
| Earing | 1.6% |
| After Stabilize Anneal | |
| Tensile strength | 48.02 |
| Yield strength | 40.98 |
| Elongation | 8.5% |

As can be seen from the above results, both batch and intermediate annealed samples provided acceptable properties for body stock. The tensile and yield strength and the elongation were increased by the stabilize anneal. The highest tensile and yield strengths and elongations were for the samples that were produced using an induction heater in the intermediate anneal followed by a stabilize anneal.

EXAMPLES 3–11

To illustrate the advantages of aluminum alloy sheet of the present invention relative to aluminum alloy sheet produced by other continuous casting and ingot casting processes, a number of aluminum alloys were formed into sheets. In the tests, six samples of 3000 series alloys produced by other continuous casting or ingot casting processes were compared with three 3000 series alloys produced according to the method of the present invention. The results are presented in Tables IX (A) and (B).

TABLE IX (A)

| | Alloy | | Composition | | | | As rolled | | | | After Bake | | |
|---|---|---|---|---|---|---|---|---|---|---|---|---|---|
| Sample # | Designation | Si | Cu | Fe | Mn | Mg | UTS | YTS | Elong. | Earing % | UTS | YTS | EL. |
| 11 | 5349D | 0.38 | 0.43 | 0.28 | 1.14 | 1.81 | 42.8 | 39.5 | 3.2 | 1.4 | 42.5 | 37.2 | 5.6 |
| 12 | 3304B | 0.19 | 0.37 | 0.41 | 0.81 | 1.2 | 42.3 | 38.8 | 4.1 | 1.7 | 42.3 | 37.1 | 5.1 |
| 13 | 3304C | 0.21 | 0.55 | 0.41 | 1.04 | 1.3 | 43.9 | 39.9 | 4.4 | 1.8 | 43.1 | 37.8 | 5.3 |
| 14 | 3304F | 0.21 | 0.55 | 0.41 | 0.83 | 1.36 | 43.3 | 39.1 | 4.4 | 1.8 | 42.6 | 37.3 | 5.3 |
| 15 | 3304CSV | 0.38 | 0.57 | 0.47 | 1.05 | 1.33 | 43.5 | 40.1 | 4.59 | 2.6 | 43.3 | 37.6 | 5.87 |
| 16 | 3304CSV (mod) | 0.38 | 0.57 | 0.46 | 1.04 | 1.35 | 42.8 | 38.9 | 4.99 | 1.7 | 42 | 36.3 | 5.58 |
| 17 | 3304CJ (mod) | 0.42 | 0.598 | 0.5 | 1.06 | 1.42 | 43.2 | 39.3 | 4.7 | 1.6 | 42.7 | 37 | 5.8 |
| 18 | 3304CJ (mod) | 0.42 | 0.59 | 0.5 | 1.03 | 1.448 | 43.25 | 39.6 | 4.6 | 1.7 | 42.7 | 37 | 5.7 |
| 19 | Comparative | AA3004 | | | | | 44.1 | 40.08 | 6.74 | 1.8 | 41.1 | 37.28 | 5.88 |

(B)

| Sample # | Hot mill anneal temp | Total cold roll red % to (first) anneal point | Cold mill first anneal temp | Total cold roll red % from first anneal point to second anneal point | Cold mill second anneal temp | Total final cold mill red % |
|---|---|---|---|---|---|---|
| 74 | 825 | 74 | N/A | N/A | 705 | 45 |
| 75 | 825 | 53 | N/A | N/A | 705 | 65 |
| 76 | 825 | 75 | N/A | N/A | 705 | 60 |
| 77 | 825 | 75 | N/A | N/A | 705 | 60 |
| 78 | 825 | 74 | N/A | N/A | 705 | 60 |
| 79 | N/A | 41 | 825 | 60 | 705 | 55 |
| 80 | N/A | 33 | 825 | 60 | 705 | 55 |
| 81 | N/A | 42 | 825 | 60 | 705 | 55 |
| 82 | 620 F. self anneal | | 3.91% total cold work to finish gauge | | | |

The balance of the composition in each sample was aluminum. Samples 74–81 were continuously cast in a block caster and then continuously hot rolled. Samples 74–78 were annealed, cold rolled, annealed a second time, and cold rolled to form the aluminum alloy sheet. In accordance with the process of the present invention, samples 79–81 were cold rolled, annealed, cold rolled, annealed, and cold rolled to form the aluminum alloy sheet. The various anneals were each for about 3 hours. Samples 74, 76–79, and 82 were fabricated into cans on conventional canmaking equipment and the canmaking behavior of the samples determined.

Table X illustrates the results of testing the processed sheets.

TABLE X

| | BODYSTOCK PRODUCT PROGRESSION | | | | |
|---|---|---|---|---|---|
| SAMPLE | ALLOY | SCORING | BUCKLE | NECKING/ FLANGING | EARING |
| 74 | 5349D | Severe | Fair | Very Poor | 1.7% |
| 76 | 3304C | Severe | Good | Poor | 2.4% |
| 77 | 3304F | Fair | Fair | Fair | 2.4% |
| 78 | 3304CSV | Good | Good | Fair | 2.6% |
| 79 | 3304 (MOD) | Good | Good | Good | 1.7% |
| 82 | | Comparative | | | 2.0% |

Samples 74 and 76–77 produced scored cans and demonstrated poor necking/flange behavior. Samples 74 and 77 further demonstrated a fair buckle strength while sample 76 demonstrated poor earing. Sample 77 exhibited fair qualities in can scoring, buckle strength, and necking/flange behavior but a very poor earing. In sharp contrast, sample 79, which was fabricated by the process of the present invention had a low degree of can scoring and acceptable buckle strength, necking/flange behavior, and earing. Sample 82, which was produced by ingot casting techniques and is considered high quality canmaking stock, in fact had a higher earing than sample 79.

Samples 78 and 79 were compared to sample 82, which is high quality canmaking sheet prepared by ingot casting techniques. The various sheet samples were formed into cans. The results are presented in Table XI below.

TABLE XI

| | | BODYMAKER | | | After-Deco/IBO Ovens | | |
|---|---|---|---|---|---|---|---|
| SAMPLE | ALLOY | UTS (ksi) | YTS (ksi) | Elong. (%) | UTS (ksi) | YTS (ksi) | Elong. (%) |
| 78 | 3304 CSV | 51.10 | 47.50 | 0.90 | 47.00 | 40.10 | 2.90 |
| 79 | 3304 CSV (modified) | 48.95 | 45.66 | 1.08 | 44.34 | 38.43 | 3.76 |
| 82 (Comparative) | 3004/3104 | 48.96 | 45.06 | 1.63 | 43.25 | 38.67 | 3.82 |

The ultimate tensile strength (UTS), yield tensile strength (YTS), and elongation (Elong) were measured after the container exited the bodymaker and after the container exited the deco step. The deco step or after bake step included heating the alloy sheet to about 400° F. for about 10 minutes. The bodymaker samples are the mechanical properties of the container thick wall in a transverse direction.

Sample 78 exhibited a greater UTS and YTS and lower elongation than sample 79 after the bodymaker and the after-deco step. Sample 79 exhibited more elongation than sample 78, especially after the deco step. In fact, the properties of sample 79 mirrored the properties of sample 82, which, as noted above, is considered high quality canmaking stock, in both UTS and YTS after the bodymaker and deco step and in elongation after the deco step. The differences in physical properties of samples 79 and 82 in each of these categories were within testing error of one another. Sample 82, however, did have a measurably higher elongation than sample 16 after the bodymaker. Nonetheless, sample 79 has canmaking properties similar to sample 82. This is a surprising and unexpected result for continuously cast aluminum alloy sheet which has significantly more cold work than ingot cast sheet.

While various embodiments of the present invention have been described in detail, it is apparent that modifications and adaptations of those embodiments will occur to those skilled in the art. It is to be expressly understood that such modifications and adaptations are within the spirit and scope of the present invention.

What is claimed is:

1. A method for producing aluminum alloy sheet, comprising:

(a) continuously casting an aluminum alloy melt to form a cast strip;

(b) hot rolling the cast strip to form a hot rolled strip;

(c) cold rolling the cooled strip to form a partially cold rolled strip;

(d) annealing the partially cold rolled strip to form a first intermediate annealed strip;

(e) cold rolling the first intermediate annealed strip to form a further cold rolled strip;

(f) annealing the further cold rolled strip to form a second intermediate annealed strip;

(g) cold rolling the second intermediate annealed strip to form a final cold rolled strip;

(h) annealing the final cold rolled strip to form aluminum alloy sheet.

2. The method of claim 1, wherein the hot rolled strip is not subject to an anneal before the cold rolling step (c).

3. The method of claim 1, further comprising between the hot rolling step (b) and the cold rolling step (c) the step of:

cooling the hot rolled strip to a temperature below the recrystallization temperature of the hot rolled strip.

4. The method of claim 1, wherein in the total reduction in thickness of the strip in each of cold rolling steps (e) and (g) are maintained at a level below the level required for the strip to realize a full hard state.

5. The method of claim 4, wherein the total reduction in thickness of the strip in cold rolling steps (e) and (g) is less than about 73%.

6. The method of claim 1, wherein the aluminum alloy sheet has an as-rolled ultimate tensile strength of at least about 42.5 ksi, an as-rolled yield tensile strength of at least about 38.5 ksi, an earing of no more than about 2.0%, and an as-rolled elongation of more than about 4%.

7. The method of claim 1, wherein the aluminum alloy sheet includes the following components:

(i) from about 0.85 to about 1.20 wt % manganese;

(ii) from about 0.85 to about 1.5 wt % magnesium;

(iii) from about 0.20 to about 0.60 wt % copper;

(iv) from about 0.3 to about 0.5 wt % silicon; and (v) from about 0.20 to about 0.60 wt % iron, with the balance being aluminum and incidental additional materials and impurities.

8. The method of claim 7, wherein the sum total of the incidental additional materials and impurities does not exceed 0.15 wt %.

9. The method of claim 1, wherein the aluminum alloy sheet has an after-bake yield tensile strength of at least about 37 ksi, an earing of less than about 1.8%, an elongation more than about 4.5%, and an after-bake ultimate tensile strength of at least about 43 ksi.

10. The method of claim 1, wherein in the hot rolling step (b) the thickness of the cast strip is reduced by at least about 70%.

11. The method of claim 1, wherein in hot rolling step (b) the gauge of the cast strip ranges from about 0.50 to about 0.95 inches, and the gauge of the hot rolled strip ranges from about 0.06 to about 0.14 inches.

12. The method of claim 3, wherein in the cooling step the hot rolled strip is allowed to cool to a temperature ranging from about 75 to about 140° F.

13. The method of claim 3, wherein the cooled strip does not undergo solution heat treatment.

14. The method of claim 1, wherein in cold rolling step (c) the hot rolled strip is reduced in thickness by an amount ranging from about 20 to about 45%.

15. The method of claim 1, wherein in annealing step (d) the annealing temperature ranges from about 700 to about 900° F.

16. The method of claim 1, further comprising after annealing step (d) the step of cooling the temperature of the first intermediate annealed strip to a temperature less than the recrystallization temperature of the strip.

17. The method of claim 1, wherein, after the annealing step (d) the further cold rolled strip does not undergo solution heat treatment.

18. The method of claim 1, wherein in cold rolling step (e) the first intermediate annealed strip is reduced in thickness by an amount of less than about 73%.

19. The method of claim 1, wherein in cold rolling step (e) the gauge of the further cold rolled strip ranges from about 0.015 to about 0.040 inches.

20. The method of claim 1, wherein the annealing step (f) occurs in a batch heater or a continuous heater.

21. The method of claim 20, wherein in annealing step (f) the anneal temperature for the batch heater ranges from about 600 to about 900° F. and for the continuous heater from about 700 to about 1050° F.

22. The method of claim 1, further comprising after annealing step (f) the step of cooling the temperature of the second intermediate annealed strip to a temperature less than the recrystallization temperature of the strip.

23. The method of claim 1, wherein, after the annealing step (f) the final cold rolled strip does not undergo solution heat treatment.

24. The method of claim 1, wherein the annealing step (h) occurs in a continuous heater or a batch heater.

25. The method of claim 24, wherein in the annealing step (h) the anneal temperature ranges from about 120 to about 205° C. for the batch heater and from about 145 to about 260° C. for the continuous heater.

26. The method of claim 1, wherein the hot rolling step b) is performed in the absence of homogenization.

27. The method of claim 1, wherein the duration of said annealing steps (d),(f) and (h) is at least about 0.5 hours.

* * * * *

UNITED STATES PATENT AND TRADEMARK OFFICE

CERTIFICATE OF CORRECTION

PATENT NO. : 6,579,387 B1
DATED : June 17, 2003
INVENTOR(S) : Selepack et al.

It is certified that error appears in the above-identified patent and that said Letters Patent is hereby corrected as shown below:

Title page,
Item [63], Related U.S. Application Data, please delete "which is a continuation-in-part of", and please delete "which is a continuation-in-part of" and insert -- and -- therefor.

Signed and Sealed this

Eleventh Day of November, 2003

JAMES E. ROGAN
*Director of the United States Patent and Trademark Office*